US009320980B2

(12) United States Patent
Schweikardt et al.

(10) Patent No.: US 9,320,980 B2
(45) Date of Patent: Apr. 26, 2016

(54) MODULAR KINEMATIC CONSTRUCTION KIT

(71) Applicant: Modular Robotics Incorporated, Boulder, CO (US)

(72) Inventors: Eric Schweikardt, Boulder, CO (US); Jonathan Hiller, Boulder, CO (US)

(73) Assignee: MODULAR ROBOTICS INCORPORATED, Boulder, CO (US)

( * ) Notice: Subject to any disclaimer, the term of this patent is extended or adjusted under 35 U.S.C. 154(b) by 61 days.

(21) Appl. No.: 13/664,384

(22) Filed: Oct. 30, 2012

(65) Prior Publication Data

US 2013/0109267 A1 May 2, 2013

Related U.S. Application Data

(60) Provisional application No. 61/553,305, filed on Oct. 31, 2011.

(51) Int. Cl.
*A63H 33/04* (2006.01)

(52) U.S. Cl.
CPC ..... *A63H 33/04* (2013.01); *A63H 33/042* (2013.01); *A63H 33/046* (2013.01)

(58) Field of Classification Search
CPC ..... A63H 33/046
USPC ..... 446/90–92, 102, 122, 125, 484
See application file for complete search history.

(56) References Cited

U.S. PATENT DOCUMENTS

| | | | | |
|---|---|---|---|---|
| 2,970,388 A | | 2/1961 | Yonkers | |
| 3,184,882 A | | 5/1965 | Vega | |
| 3,640,018 A | | 2/1972 | Light | |
| 4,183,173 A | | 1/1980 | Ogawa | |
| 4,629,192 A | * | 12/1986 | Nichols | A63F 9/12 273/146 |
| 5,172,534 A | | 12/1992 | Milner et al. | |
| 5,746,638 A | | 5/1998 | Shiraishi | |
| 6,062,937 A | * | 5/2000 | Kikuchi | A63H 33/042 446/484 |
| 6,454,624 B1 | | 9/2002 | Duff et al. | |

(Continued)

FOREIGN PATENT DOCUMENTS

| | | | | |
|---|---|---|---|---|
| GB | 2465339 A | * | 5/2010 | A63H 33/04 |
| JP | 2012243764 | * | 12/2012 | A63H 33/04 |

OTHER PUBLICATIONS

Young, Lee W., "International Search Report and Written Opinion re Application No. PCT/US12/62630", Feb. 15, 2013, Published in: US.

(Continued)

*Primary Examiner* — Gene Kim
*Assistant Examiner* — Matthew B Stanczak
(74) *Attorney, Agent, or Firm* — Neugeboren O'Dowd PC

(57) ABSTRACT

A construction kit comprises a plurality of building modules, wherein at least one of the building modules is functional and adapted to perform a specific behavior. In some embodiments, each of the building modules includes at least one connection face adapted to pass either data or power from a first face of a first building module to a first face of a second building module. In certain other embodiments, each connection face of the building modules is electrically connected with each of the other faces. The kit includes at least one connector adapted to couple the at least one functional module to at least one other module while providing up to three degrees of freedom between the functional module and the at least one other module.

18 Claims, 45 Drawing Sheets

(56) References Cited

U.S. PATENT DOCUMENTS 6,505,087 B1 1/2003 Lucas et al.
6,575,802 B2 6/2003 Yim et al.
6,585,553 B1 7/2003 Fetridge et al.
6,605,914 B2 8/2003 Yim et al.
6,626,727 B2 9/2003 Balanchi
6,733,360 B2 5/2004 Dooley et al.
6,795,318 B2 9/2004 Haas et al.
6,846,216 B1 * 1/2005 Balanchi ..... A63H 33/046 275/157 R
6,893,316 B2 5/2005 Maxwell et al.
6,902,461 B1 6/2005 Munch et al.
6,939,192 B1 9/2005 Munch et al.
6,969,294 B2 * 11/2005 Vicentelli ..... G09F 7/04 446/129
7,038,567 B2 5/2006 Vicentelli
7,066,778 B2 * 6/2006 Kretzschmar ..... A63H 33/046 446/124
7,234,986 B2 6/2007 Kowalski et al.
7,255,624 B2 * 8/2007 Daftari ..... A63H 33/046 446/485
7,273,404 B2 9/2007 Kowalski et al.
7,322,873 B2 1/2008 Rosen et al.
7,371,147 B2 * 5/2008 Tusacciu ..... A63H 33/046 446/92
7,641,534 B2 1/2010 Homan
7,833,078 B2 * 11/2010 Kretzschmar ..... A63H 33/046 446/137
7,892,065 B2 2/2011 Vicentelli
7,918,708 B2 4/2011 Kowalski
7,955,155 B2 * 6/2011 Tremblay ..... A63H 33/046 446/85
8,292,687 B2 10/2012 Tremblay et al.
8,303,366 B2 * 11/2012 Tremblay ..... A63H 33/046 446/85
8,475,225 B2 * 7/2013 Kretzschmar ..... A63H 33/046 446/137
2003/0148700 A1 * 8/2003 Arlinsky ..... A63H 33/04 446/91
2004/0018473 A1 1/2004 Tusacciu
2004/0077258 A1 * 4/2004 Vicentelli ..... G09F 7/04 446/85
2005/0026535 A1 * 2/2005 Balanchi ..... A63H 33/046 446/85
2005/0118925 A1 * 6/2005 Kretzschmar ..... A63H 33/046 446/124
2005/0118926 A1 * 6/2005 Roger ..... A63H 33/046 446/137
2005/0124259 A1 * 6/2005 Tusacciu ..... A63H 33/046 446/129
2005/0197038 A1 * 9/2005 Tusacciu ..... A63H 33/046 446/92
2005/0234592 A1 10/2005 McGee et al.
2006/0095893 A1 5/2006 Vahid et al.
2006/0100739 A1 5/2006 Raffle et al.
2006/0131989 A1 * 6/2006 Daftari ..... A63H 33/046 310/309
2006/0136180 A1 6/2006 Hansen et al.
2006/0205316 A1 * 9/2006 Kretzschmar ..... A63H 33/046 446/92
2006/0240737 A1 * 10/2006 Yoon ..... A63H 33/046 446/92
2007/0100468 A1 * 5/2007 Yun ..... A63H 33/046 700/1
2007/0190892 A1 * 8/2007 Manvelian ..... A63H 33/046 446/92
2007/0262984 A1 11/2007 Pruss
2007/0287353 A1 * 12/2007 Vicentelli ..... A63H 33/046 446/92
2008/0139077 A1 * 6/2008 Patton ..... 446/92
2008/0196533 A1 8/2008 Bergamasco et al.
2009/0015361 A1 * 1/2009 Tremblay ..... A63H 33/046 335/285
2009/0170396 A1 * 7/2009 Tardif ..... A63H 33/26 446/92
2009/0288283 A1 * 11/2009 Fullerton et al. ..... 29/428
2011/0039473 A1 * 2/2011 Kretzschmar ..... A63H 33/046 446/92
2011/0201247 A1 * 8/2011 Tremblay ..... A63H 33/046 446/92
2011/0263178 A1 * 10/2011 Tremblay ..... A63H 33/046 446/92
2011/0300772 A1 * 12/2011 Risvig ..... 446/91
2012/0122059 A1 5/2012 Schweikardt
2013/0029559 A1 * 1/2013 Tremblay ..... A63H 33/046 446/91
2015/0258461 A1 * 9/2015 Balanchi ..... A63H 33/046 446/92

OTHER PUBLICATIONS

Schweikardt, et al. , "roBlocks: A Robotic Construction Kit for Mathematics and Science Education", "Webpage found at http://dl.acm.org/citation.cfm?id=1180995.11800995 downloaded Jan. 18, 2013", Nov. 4, 2006, p. 4, Published in: CA.
Schweikardt, et al. , "Learning About Complexity with Modular Robots", "Digital Games and Intelligent Toys Based Education, 2008", Nov. 17, 2008, p. 8, Publisher: Second IEEE International Conference, Published in: US.
Wikipedia, "Capsela", Webpage found at http://en.wikipedia.org/wiki/Capsela downloaded Feb. 4, 2013, p. 5, Publisher: Wikipedia Foundation, Inc.
"Cube World", Webpage found at http://www.amazon.com/Cube-World-The-Complete-Series/Im/R33XSNNN56G29H downloaded Feb. 4, 2013, p. 4.
"Fischertechnik", Webpage found at http://www.fischertechnik.biz/ downloaded Feb. 4, 2013, 1985, p. 2, Publisher: Studica.
"Geomag", Webpage found at http://en.wikipedia.org/wiki/GEOMAG downloaded Feb. 4, 2013, 1998, p. 6, Publisher: Geomag.
"Lego Mindstorms", Webpage found at http://mindstorms.lego.com/en-us/Default.aspx downloaded Feb. 6, 2013, 2012, p. 3, Publisher: The Lego Group, Published in: US.
"Meccano", Webpage found at http://www.meccano.com/ downloaded Feb. 4, 2013, p. 1, Publisher: Meccano.
"Rokenbok", Webpage found at http://www.rokenbok.com/ downloaded Feb. 4, 2013, 2012, p. 2, Publisher: Rokenbok Toy Company.
"Sifteo Cubes", Webpage found at https://www.sifteo.com/ downloaded Feb. 4, 2013, 2013, p. 4, Publisher: Sifteo Inc.
"Vex", Webpage found at http://www.vexrobotics.com/vex/ downloaded Feb. 4, 2013, p. 2, Publisher: Vex Robotics, Inc.
Wittmann-Regis, Agnes, "International Preliminary Report on Patentability re Application No. PCT/US2012/062630", May 15, 2014, p. 8, Published in: CH.
Aihua, Wang, "Chinese Office Action re Application No. 201280053465.2", Aug. 5, 2015, p. 18, Published in: CN.
Schweikardt, et al., "roBlocks: A Robotic Construction Kit for Mathematics and Science Education", Nov. 2, 2006, p. 4, Publisher: ICMI, Published in: CA.

* cited by examiner

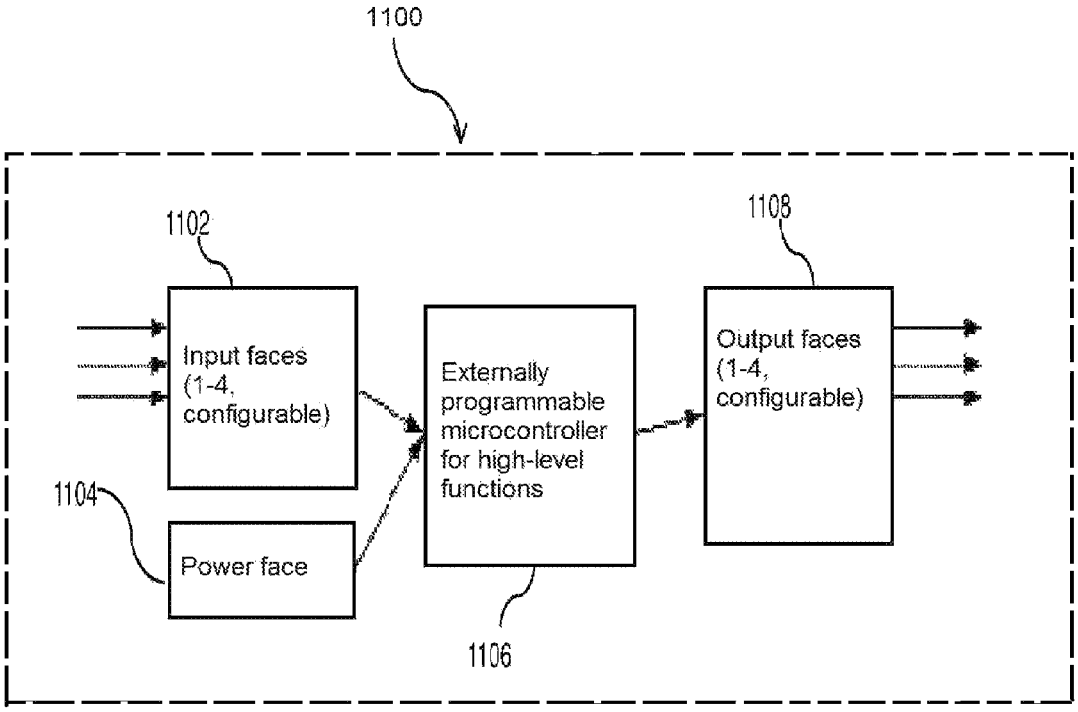
Figure 11A (Think)
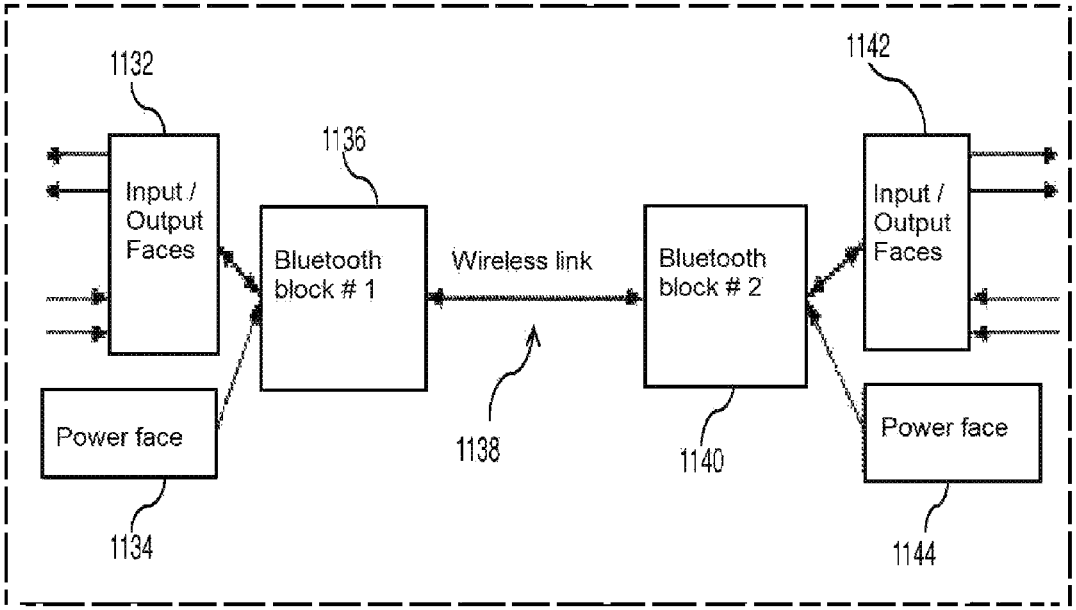
Figure 11B (Bluetooth)

(Bluetooth 2)

MODULAR KINEMATIC CONSTRUCTION KIT

PRIORITY AND RELATED APPLICATIONS

This application claims priority to U.S. Provisional Patent Application No. 61/553,305 filed on Oct. 31, 2012 and assigned to Modular Robotics Incorporated of Boulder, Colo. The details of Application No. 61/553,305 are incorporated by reference into the present application in their entirety and for all proper purposes. This application is related to U.S. Patent Application Publication No. 2012/0122059 filed in the United States Patent and Trademark Office under 35 USC §371(c)(1) on Jan. 24, 2012 and assigned U.S. Ser. No. 13/386,707. The details of application Ser. No. 13/386,707 are also incorporated by reference into the present application in their entirety and for all proper purposes.

FIELD OF THE INVENTION

Aspects of the present invention relate generally to the learning of science, technology, engineering, and mathematics, and in particular to a robotics construction kit that utilizes modular components to form a complete construction.

BACKGROUND

Various systems, kits and toys exist for children to construct and program robots. Systems do not exist that allow one to take advantage of modular blocks and other components while enabling robots to be built without sophisticated programming techniques and highly specialized knowledge. While there are some existing systems for constructing robots are centralized with one computer that controls robot operation, these existing systems do not embody a distributed computing model and do not allow the modular construction of robots by beginners. The few toys that contain more than one node of computation are passive entertainment products and are limited in their modes of interacting with the physical world.

Mechatronics is generally known as the combination of mechanical engineering, electronic/electrical engineering, computer science, software engineering, control engineering, and systems design in order to design and manufacture useful products. Regardless of how this term is defined, aspects of the present invention invoke mechatronics as a multidisciplinary field of engineering.

U.S. Patent Application No. 2012/0122059, assigned to Modular Robotics Incorporated of Boulder, Colo., addresses some of these issues, and allows the construction of simple machines. However, the inventions described in that application do not provide a high degree of customization and are limited in the mechatronics that can be embodied in such constructions. This applies both to functionality and mechanical adaptability. There is currently a significant gap between smart construction blocks and inert bricks (such as LEGO™ bricks) that could allow for easily reconfigurable structures with mechanical and electrical function. See Schweikardt and M. D. Gross, "A Brief Survey of Distributed Computational Toys," presented at DIGITEL 2007: The First IEEE International Workshop on Digital Game and Intelligent Toy Enhanced Learning, Jhongli, Taiwan, 2007. What is needed is a modular construction kit that provides units with a common interface to build castles, electrical circuits, remote controlled cars, autonomous legged robots, and many other intriguing active creations.

SUMMARY OF THE INVENTION

In one embodiment, a construction kit comprises a plurality of building modules, wherein at least one of the building modules is functional and adapted to perform a specific behavior. The kit includes at least one connector adapted to couple the at least one functional module to at least one other module while providing up to three degrees of freedom between the functional module and the at least one other module. In certain embodiments, the at least one connector enables at least voltage flow to and from the at least one functional module.

In another embodiment, a functional building module for use in a construction kit, the functional building module comprises an enclosure defining a plurality of corners, at least one electronic component mounted within the enclosure, at least one recessed magnetic contact surface located proximate to at least one of the plurality of enclosure corners, and at least one conductive connector. In certain embodiments, the at least one conductive connector is adapted to engage in the at least one recessed contact surface and adapted to provide up to three degrees of freedom between the functional building module and a second building component. In other embodiments, the at least one conductive connector enables at least voltage flow to and from the at least one electronic component.

In yet another embodiment, a construction kit comprising, a plurality of building modules, wherein at least one of the building modules is functional and adapted to perform a specific behavior. In some embodiments, each of the building modules includes at least one connection face adapted to pass either data or power from a first face of a first building module to a first face of a second building module. In certain other embodiments, each connection face of the building modules is electrically connected with each of the other faces. The kit includes at least one connector adapted to couple the at least one functional module to at least one other module while providing up to three degrees of freedom between the functional module and the at least one other module.

Other embodiments will become known to one of skill in art after reading the following specification in conjunction with the figures and claims.

BRIEF DESCRIPTION OF THE DRAWINGS

Various aspects and embodiments of the invention is illustrated by the following drawings figures in conjunction with the accompanying description, in which:

FIGS. 11A-11C show several alternative embodiments of the functions that a think block may take in accordance with aspects of the present invention;

DETAILED DESCRIPTION

Aspects of the invention utilize low-cost mechatronic bricks, blocks, and other components (functional and passive) to allow users to explore applications in education, entertainment, and science. While embodiments disclosed in this application are certainly intended to be used in a simple educational and purely entertainment setting, there are other aspects that can be applied to more complex and institutionalized learning environments such as universities or private research and development facilities.

Components of the systems described herein are sometimes referred to as "blocks" or "modules." It is not intended to limit the physical characteristics of the various construction components by referring to any of them as either blocks or modules. To the contrary, it is intended that such components be given the broadest interpretation possible. As can be seen from the various embodiments and descriptions below, such components may take one of a variety of shapes, some of which do not resemble a "block" shape and some of which might not normally be interpreted as a "module." It is the intent that the use of these terms be construed to encompass any of the construction components, and their equivalents, described herein.

Aspects of the invention also embody a decentralized modular system for constructing and programming robots and concurrent communicating agents. A robotics construction kit serves as a platform for children to engage in problem-solving and innovative thinking in science, technology, engineering, and mathematics, sometimes collectively referred to as STEM. By designing and building robotics constructions from an apparently simple set of blocks that encapsulate the kinetic, electronic, and software elements of robots, children and others can encounter, explore, and experiment with basic principles of science and computation. Unlike existing robotics construction kits for education, the present invention abstracts complex behaviors into easily reconfigurable elements which scaffold the understanding of networks, kinematics, and electronics without domain-specific knowledge.

Figure 3:
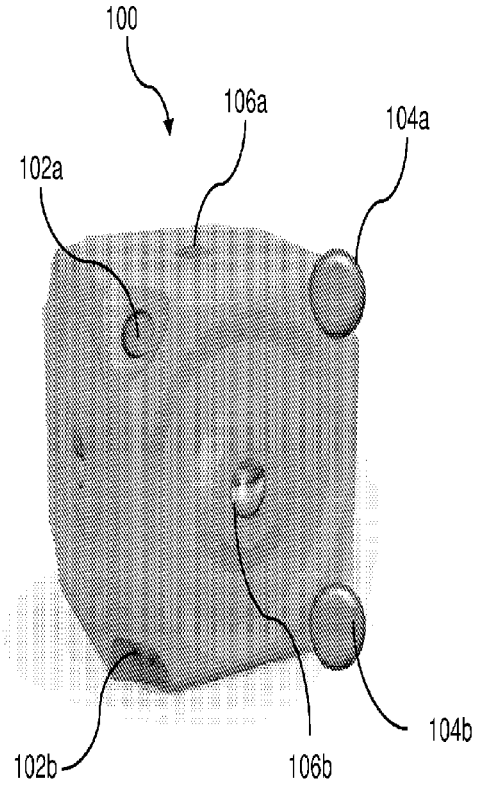
FIG. 3 shows one embodiment of an optimized production block in accordance with aspects of the present invention.

In general the modules described here are a set of compatible building blocks, each housing a distinct mechanical, electrical, audible, or visual function (See e.g. FIG. 3 described below). Abstractly, information is transferred between connected blocks in the form of a single, continuous value. This culminates in the science of building and wiring electrical circuits, where modules may have components to modify this signal such as by containing a resistor between two faces, a transistor between 3 faces, or microprocessor(s) connecting many faces. The modules may also have components to interact with the physical world, such as an LED, speaker, sensor or motor block. Other modules may simply pass the signal through, branch it (like a wire) or block the signal (like an insulator).

There are four categories of blocks: sensing blocks, thinking blocks, action blocks and utility blocks. In a production and commercial environment, different colors or textures may indicate the different block categories so that users can easily identify which components to work within a given construction scenario. Generally speaking, sensor/sensing blocks sense signals from the environment (including light, sound, touch, motion and distance from objects) and pass corresponding signals to one or more connected neighboring blocks. Thinking blocks modify signals based on mathematical functions, logic, conditional statements, etc., and may take into account a plurality of input signals to generate a plurality of output signals. Action blocks convert signals they receive into various types of action. For example, a motorized block rotates with a speed dependent on the signals it receives. Other action blocks may include rotating faces, bright LEDs, and speakers. Utility blocks may include a power source, such as a battery, (e.g. lithium-ion or solar powered). Most constructions will require some type of battery or power source. Utility blocks can also include passive data-connection blocks that affect the physical form of a construction without affecting the flow or content of data such as a leg-like appendage, a wheel, or a strengthening brace. Utility blocks can include a communication block that is either hard wired or wirelessly enabled with a nearby computer or mobile device to communicate with a construction. Some utility blocks can be blocker blocks that restrict the flow of data through a construction.

An important aspect to all elemental building systems is the mechanical and electrical interface between elements. Each of the construction modules detailed herein comprise magnets embedded or otherwise attached to each corner or other joint-edge of the particular structure. Constructions then utilize simple steel balls as a multi-directional binding agent. These joints (magnet plus connection spheres) establish kinematic mechanical connections between blocks and can allow up to three degrees of freedom for motion between connected building modules. Because both magnets and the steel spheres are conductive, these mechanical bonding elements are also used to propagate an electrical ground mesh throughout the assembled structure. All magnets within each block or other module are electrically connected (e.g. hard-wired) together within the module structure itself. This allows every attached module to have an electrical ground reference. This configuration enables each face of a particular block or other module to contain a single electrical terminal (e.g. at the center), which greatly reduces the complexity over existing electrical-enabled building blocks. See P. Wyeth and G. Wyeth, "Electronic Blocks: Tangible Programming Elements for Preschoolers," presented at Eighth IFIP TC13 Conference on Human-Computer Interaction (Interact 2001), 2001. For instance, a motor module (discussed in detail as an example below) needs only a single face contact to move. The electrical return path is through the sphere-to-magnet ground mesh. Wherever a ground reference is required in a construction, a ground block that bridges the ground mesh at the corners to the contact on the face can simply be inserted into the structure.

One feature of the magnet and sphere connection embodiment described herein involves the creation of kinematic joints. Connecting modules edge to edge or corner to corner creates revolute or ball and socket joints, respectively. FIG. 3 shows one representative example of a generally cube-shaped construction module 100 that includes such magnetic connection points 102*a* and 102*b*, as well as examples of the conductive spheres 104*a* and 104*b* used to connect two or more modules together in a functional and/or mechanical construction. While not visible in FIG. 3, each of the eight corners of the module 100 includes a connection point and is capable of receiving a conductive sphere and subsequently enabling a connection between the module 100 and another module. Although the base unit module 100 shown in FIG. 3 is a single cube, the construction system as a whole is designed and adapted to be mechanically heterogeneous and allows larger bricks (e.g. a 1×1×6 unit brick) for mechanical rigidity as well as non-uniform appendages such as wheels and lightweight legs that attach to the existing grid of spheres connectors and greatly extend the potential functionality and aesthetics of the invention kit. Details of such components are described in more detail below. In one embodiment and as shown in FIG. 3, the cube is approximately 25 mm on each edge.

Figure 15A:
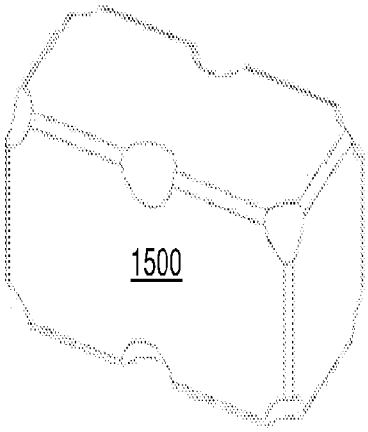
FIGS. 15A-17J show other embodiments of other block elements constructed in accordance with aspects of the present invention.
Figure 15B:
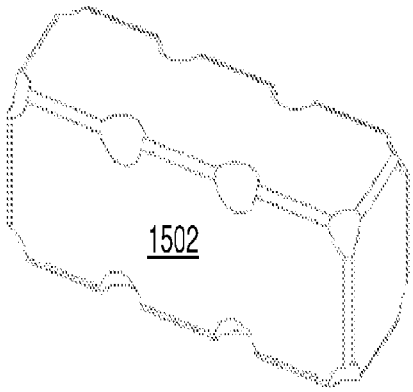
Figure 15C:
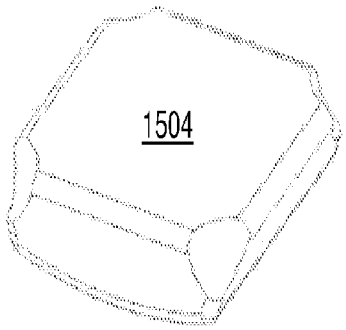
Figure 15D:
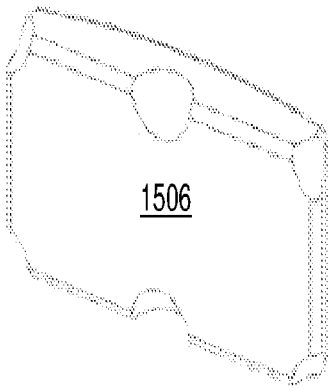
Figures 1, 15E:
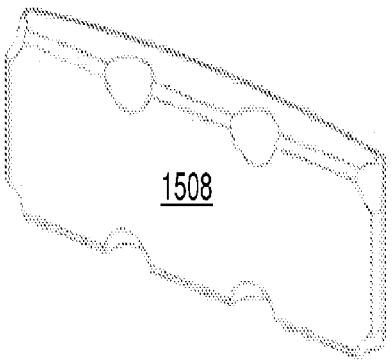
Figures 2, 15E:
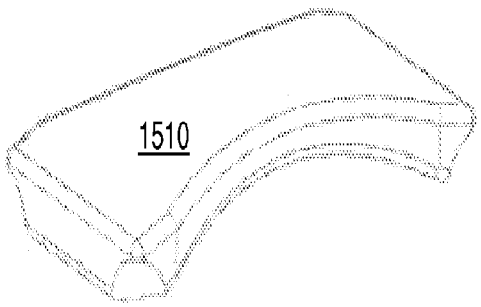
Figure 15F:
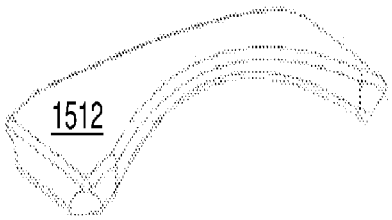
Figure 15G:
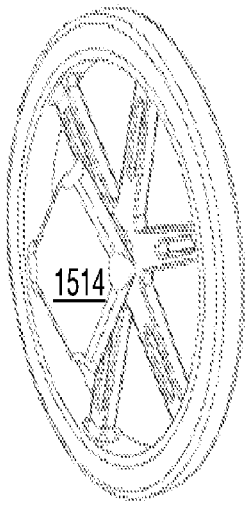
Figure 15H:
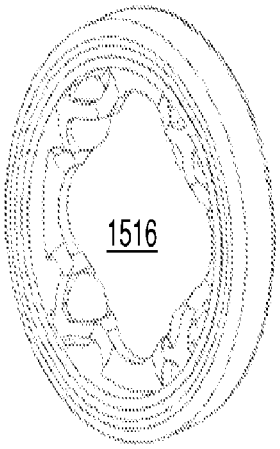
Figure 15I:
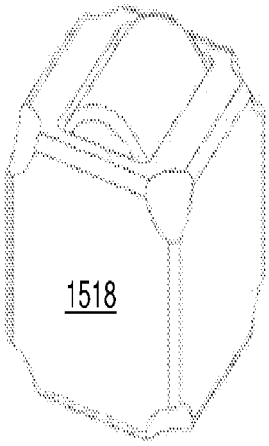
Figure 15J:
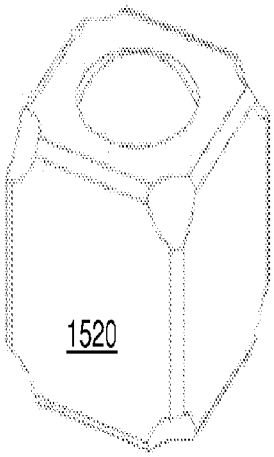
Figure 15K:
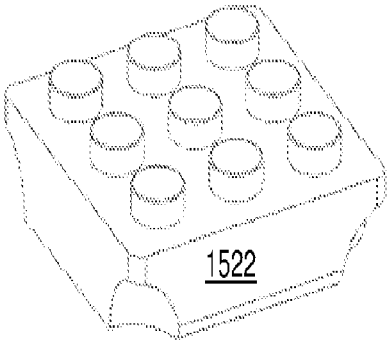
Figure 16A:
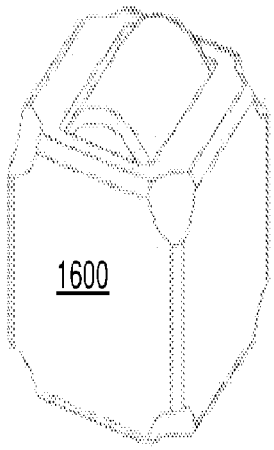
Figure 16B:
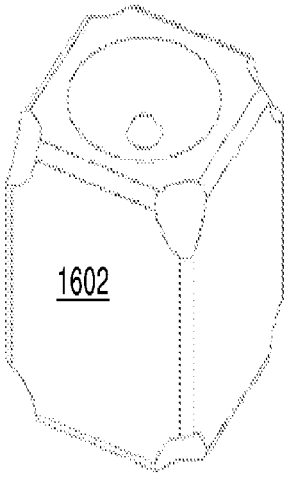
Figure 16C:
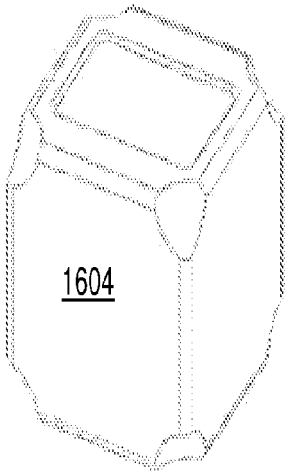
Figure 16D:
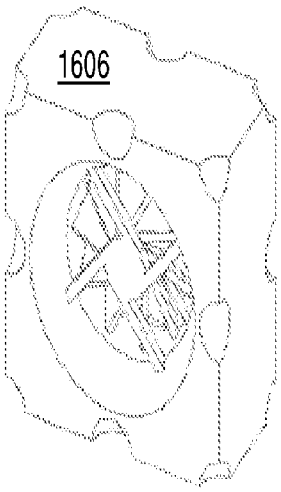
Figure 16E:
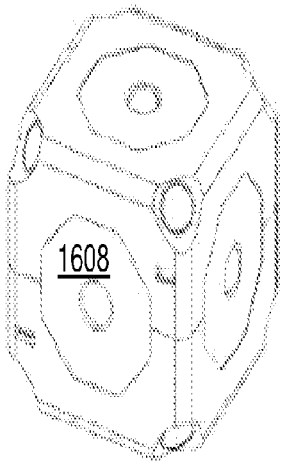
Figure 17A:
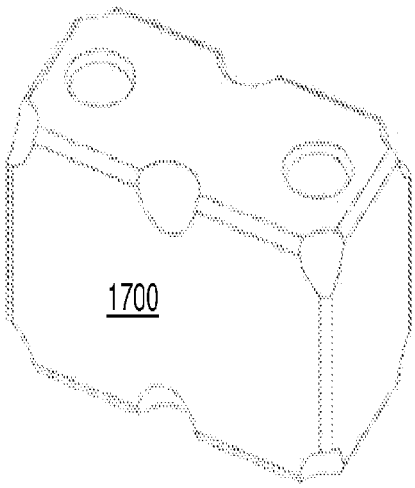
Figure 17B:
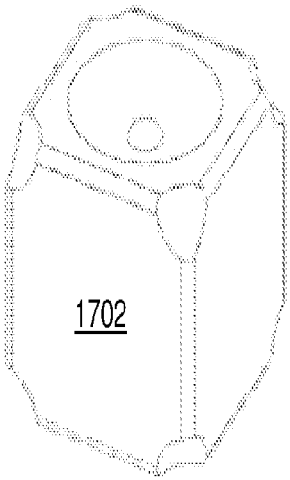
Figure 17C:
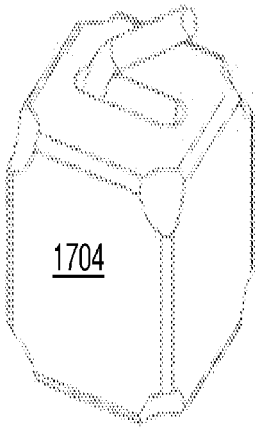
Figure 17D:
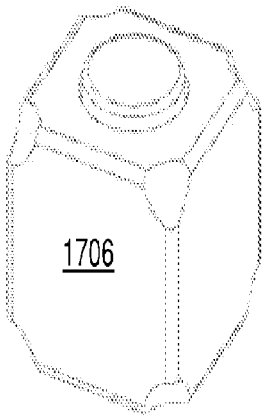
Figure 17E:
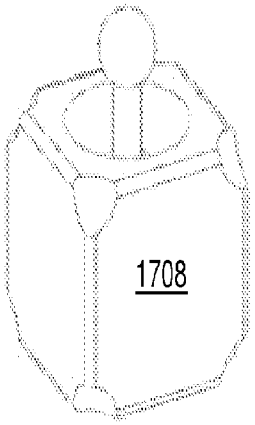
Figure 17F:
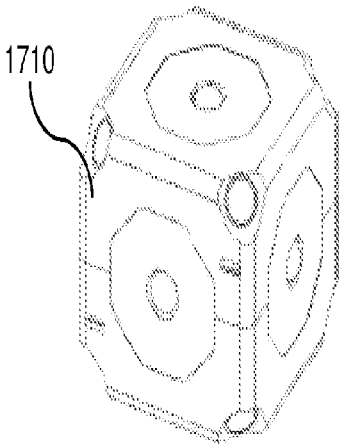
Figure 17G:
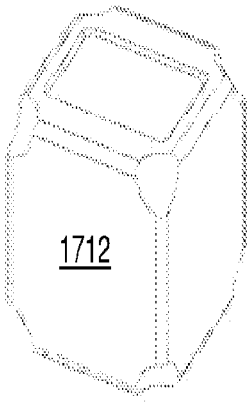
Figure 17H:
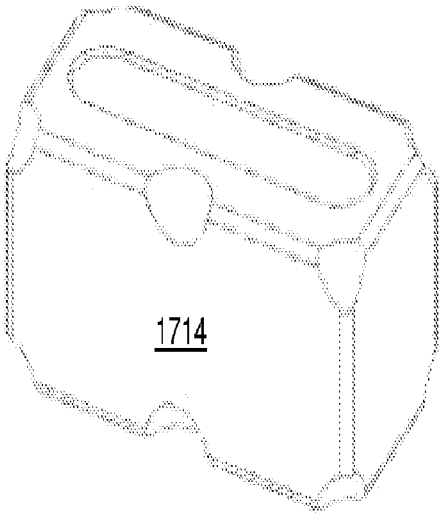
Figure 17I:
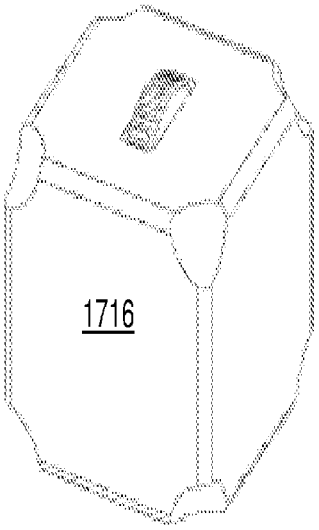
Figure 17J:
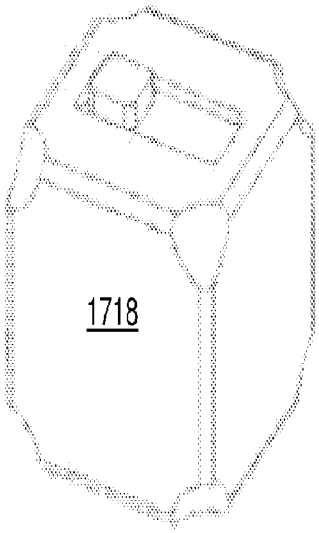

Although it is anticipated that the majority of modules constructed in accordance with the aspects disclosed herein will be very inexpensive and passive in their information processing ability, in it also anticipated that smart or "brain" modules will be included to generate arbitrary output signals either in open loop, or as a function of inputs. Brain blocks may be larger than the base module (e.g. 2×2×1 base units in size) both to make packaging feasible and to allow more inputs and outputs by having more available faces to connect to. It is contemplated that these brain blocks will have the capability of connecting to a host computer for programming, and can include wireless connectivity for remote control of creations. In either event, it is anticipated that the various types, styles, sizes and capabilities of different modules may be combined together in a multitude of ways in order to create simple to complex constructions, such as robotic devices and other mechatronic constructions. FIG. 1 described below shows one embodiment of how the various modules may be used in combination with each other.

Design and Development Modules

Figure 2:
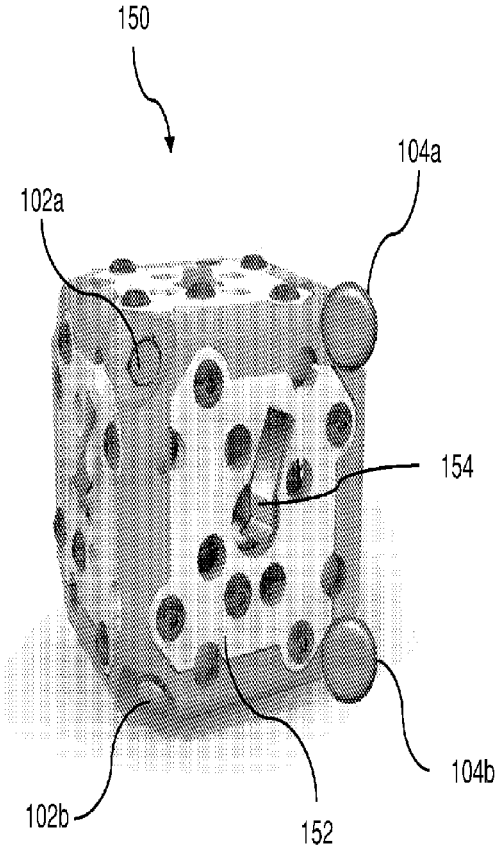
FIG. 2 shows one embodiment of a customizable development block in accordance with aspects of the present invention.

While not contemplated for commercial sale or use, aspects of the invention may also include the use of development module kit blocks that are constructed in a manner that allow for easy reconfiguration during development, testing and evaluation prior to large scale manufacturing. The 3D frame for each development module may be printed using, for example, 3D Polyjet technology. Individual faces of the modules are laser cut to contain the appropriate electrical contact, component, etc. A single face type will allow any standard electrical component to be attached to the inside of any face. FIG. 2 shows one such development module 150 that includes and supports interchangeable faces 152 for rapid reconfiguration. Various face types are preferably custom-cut to accommodate LEDs, photoresistors, knobs, buttons, or simply a blank non-functional face for structural cubes. Electrical contacts 104*a* and 104*b* as well as magnetic connection points 102*a* and 102*b* are similar to those shown and described in conjunction with FIG. 3.

With continuing reference to FIG. 2, each face that contains an electrical contact is prototyped easily by creating a cantilevered spring 154 with a conductive face. This compliance allows the connections to be robust in the face of non-perfect dimensional tolerances of the cubes themselves as may be present in a development environment. By necessity, although each of the connections in the development modules is defined by the voltage passed across it, not all connections will be capable of supplying the same amount of current under all situations. For instance, the output face of a micro controller "brain" block may be the same as the face voltage at the battery block, but it may not be able to provide enough current to turn a motor block, other motion capable block or output. For this reason, some modules may include a supplementary "power" face that should be connected to a battery block either directly or with pass-through blocks.

Figure 1A:
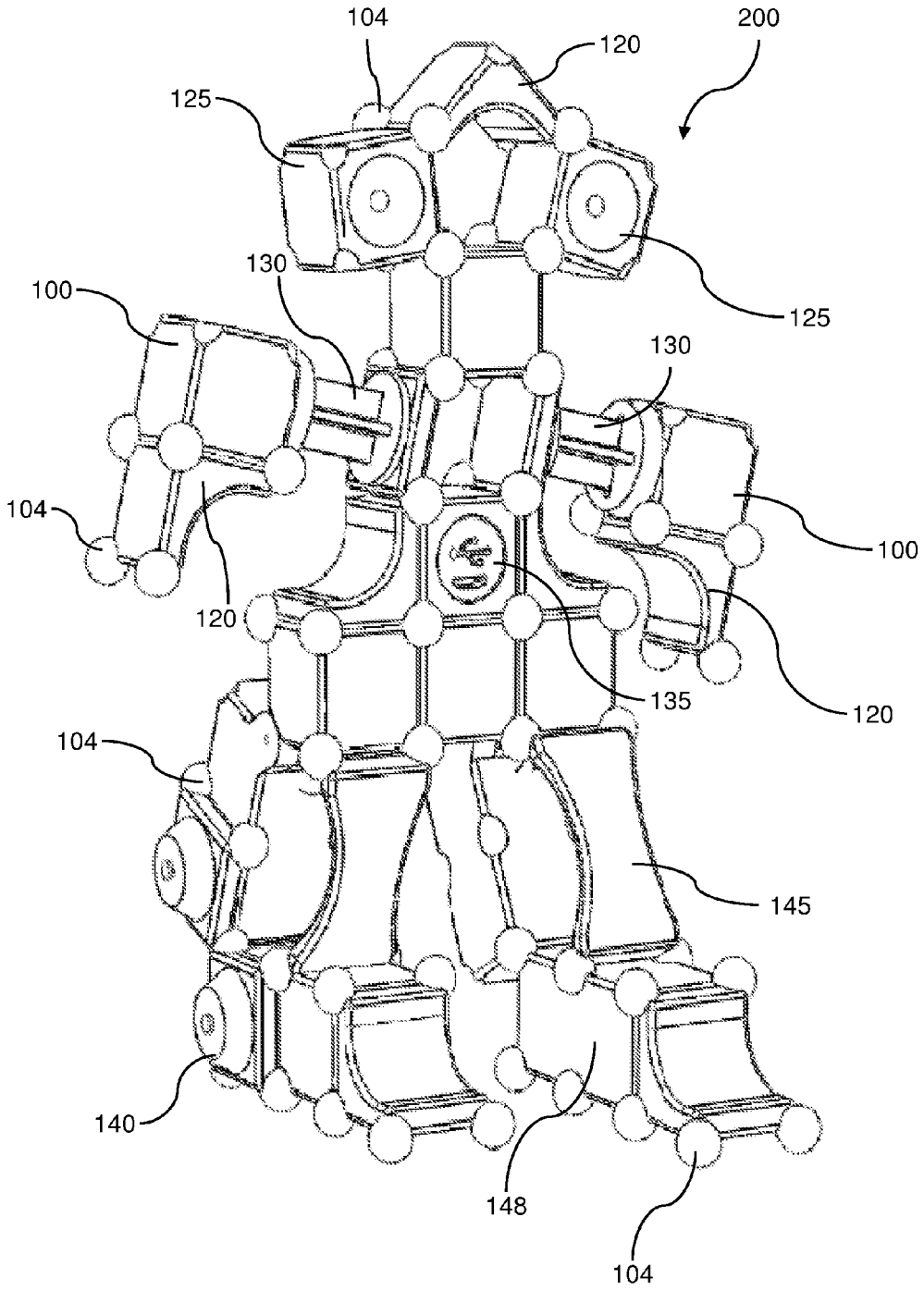
FIGS. 1A and 1B show perspectives of a completed construction in the form of a robot toy in accordance with aspects of the present invention.
Figure 1B:
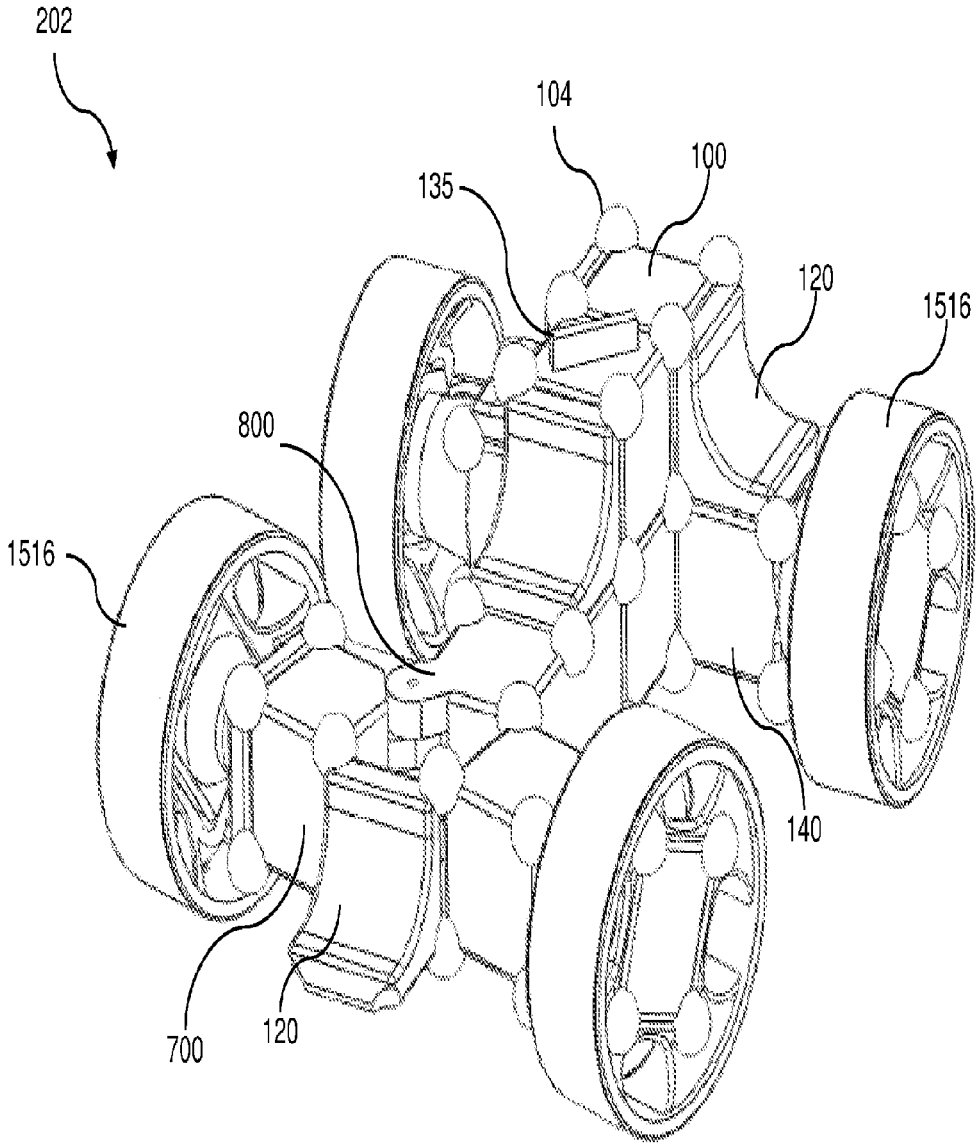

FIGS. 1A and 1B show several embodiments of a complete construction 200 and 202 built from a series of different modules designed in accordance with various aspects of the present invention. In this embodiment it is apparent that the construction takes the form of a robot (FIG. 1A) and a vehicle (FIG. 1B) and it becomes readily apparent that each is formed from modules of varying shape, size and function. For instance, robot construction 200 includes several unit blocks 100, L-blocks 120, display blocks 125, a brain block 135, one or more drive blocks 140, one or more span segments 145 and a battery block 148. Vehicle construction 202 includes many the same types of blocks and modules as construction 200 in addition to other blocks such as continuous rotation blocks 700, a brain block 135, one or more drive blocks 140, and angular rotation block 800 while forming a completely different construction. Each of these specific components, as well as others, are described in detail below. As one can begin to understand, the combination of the different structures and functions defined by the various modules can create unique designs and constructions.

Production Ready Construction Modules

Figure 3A:
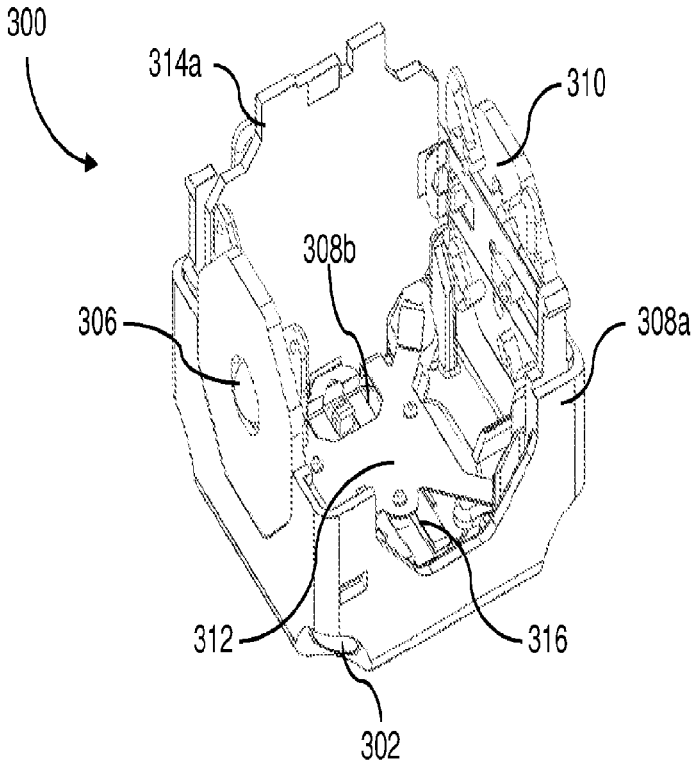
FIG. 3A is an exploded view of a production block in accordance with aspects of the present invention.

In the production and commercial environment (as opposed to design and development), the modules will be less flexible in their particular application but will be much more economical to produce. The shell of each block is made of two identical injection molded pieces with magnets molded in. Preferably the two pieces snap together securely. The injection molded faces are still interchangeable, but utilize stamped metal cantilever contacts installed on the inside that are exposed on the outside center of each face. A ground ring sits in the bottom of each half, touching the backs of the molded-in corner magnets, thereby electrically connecting them to help form the ground mesh. Both ground rings and up to 5 faces touch a single circuit board at specific locations to allow all functionality, whether simple wiring or complex circuitry, to be fully contained on the circuit board. As the two outer shells are snapped together, the circuit board and faces are pressed and held together. FIG. 3A represents a typical and preferred production module unit block 100. As can be seen in FIG. 3A, individual faces and components within the unit block 100 are not reconfigurable. The development module 300 includes design and construction flexibility not present in the production block 100. Block 300 includes two identical base halves 308*a* and 308*b* clipped together with spring clips 309. Interchangeable faces 310 (six are present in a cube formation but more or less may be present depending on the particular arrangement of the block or module) engage with the base halves and form the major part of the block structure. The faces 310 are interchangeable in the development modules 300 but are locked in place when the development cube is assembled. A circuit board 314 is mounted within the block 300 and includes exposed pad contacts, face contacts and ground rings. The circuit board 314 locks in place when the cube is assembled. A stamped metal ground ring 312 touches each of the molded in-corner magnets 302 and thereby creating a ground mesh through the block such that contact with any of the molded-in corner magnets 302 will also be a grounding contact. Conductive spheres (not shown) engage with each of the magnets 302 and provide the connection point to other blocks, modules and components. Face contacts 316 are cantilevered and engage with stamped metal face contacts 306.

In addition to the basic unit block 100, many additional modules of varying shapes, sizes and functions are contemplated by aspects of the present invention. In the following sections, the details of each of these modules and other building components are described. Some functions, such as the battery, motor, linear actuator, brain, etc. are only feasible to package in multiples of the base module size. Also, specialty shapes can be utilized for such functions as robot appendages, wheels, struts, and structural backbones. Each of these is described in detail.

Figure 3B:
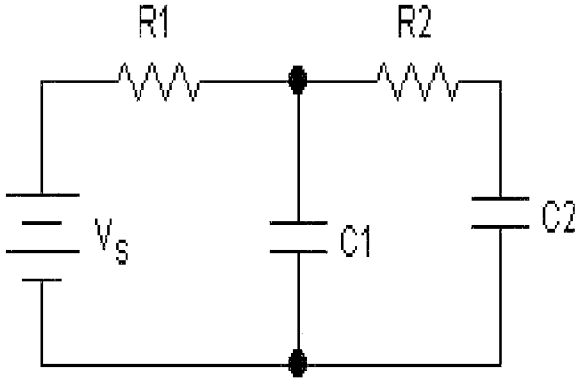
FIG. 3B is a schematic of an equivalent circuit that could be built with several blocks.

FIG. 3B is a schematic of an equivalent circuit that could be built with 5 blocks (a voltage source (battery) block, two blocks with resistors inside and two with capacitors).

General Description of Block Face Functionality

Each face of a particular module generally has one of five different functions: power output, power input, data output, data input and pass-through (agnostic). Depending on the specific rules and "recipes" associated with a particular module or block, the format and functionality of each of the faces will vary accordingly. Power output faces (e.g. on the battery block) are intended to connect to power input faces and provide power to active blocks. Data output faces are intended to connect to data input faces and transmit data in one direction. Pass through faces are present in quantities of two or greater on a block and pass power or data without modification. By using blocks with pass through faces, spatial gaps between input and output faces may be bridged. In connection with the description of many of the modules below reference will be made to functional block diagrams which describe the face-by-face functions and how data and power is transferred through each block and to potentially neighboring blocks.

While reference is made herein to the use of power input faces as well as power output faces, in various embodiments, and because the power may be bussed between the various faces of a particular block, a single face may function as either a power input face or a power output face.

With reference to FIGS. 4-19 (including all of the associated sub-figures) various modules, blocks, and other passive and active construction components are shown as well as functional diagrams that detail how each of the functional modules work and otherwise pass information back and forth to each other. It should be generally understood that the details of the following components and the specific functions and utility associated with each of these components are intended to be used in a wide variety of combinations and the presentation of these individual components in the following descriptions should not be construed as an intention to limit the disclosure in any way. To the contrary, one of skill in the art would recognize the ability to combine any of these components in any quantity to form one or more different constructions. Similarly, while several embodiments of assembled components are referred to herein, it is not the intention to limit the scope of the claims to any of these particular embodiments.

Figure 4A:
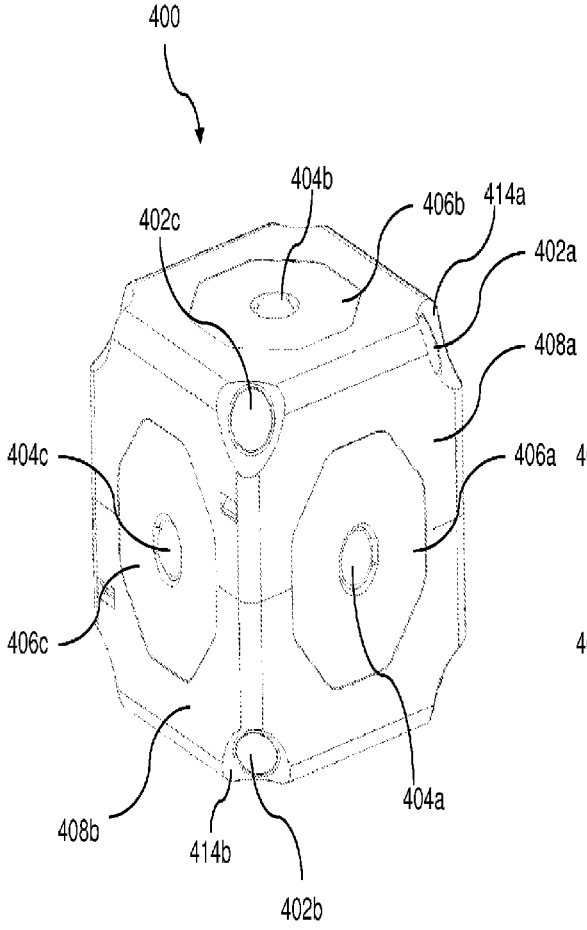
FIGS. 4A-4E show various embodiments of a unit block in accordance with aspects of the present invention.
Figure 4B:
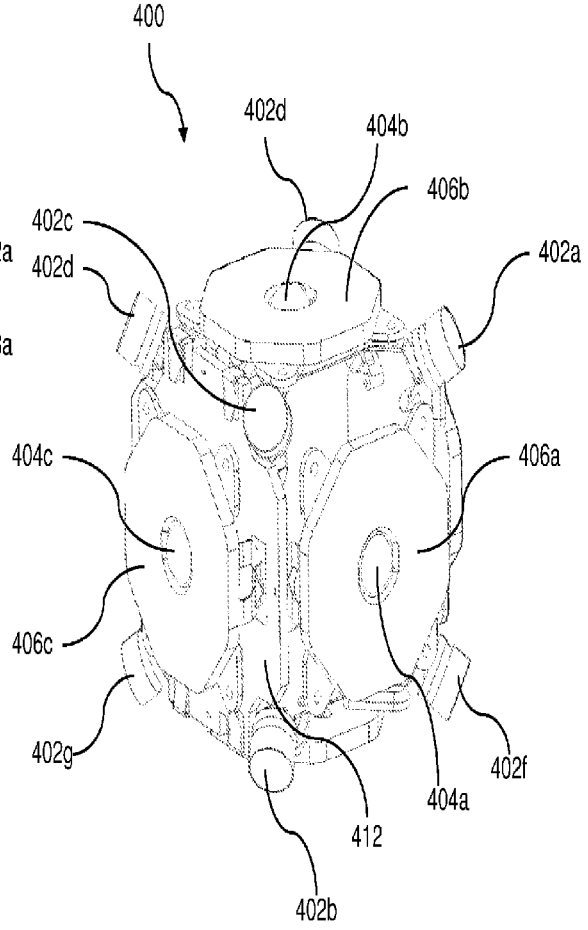
Figure 4C:
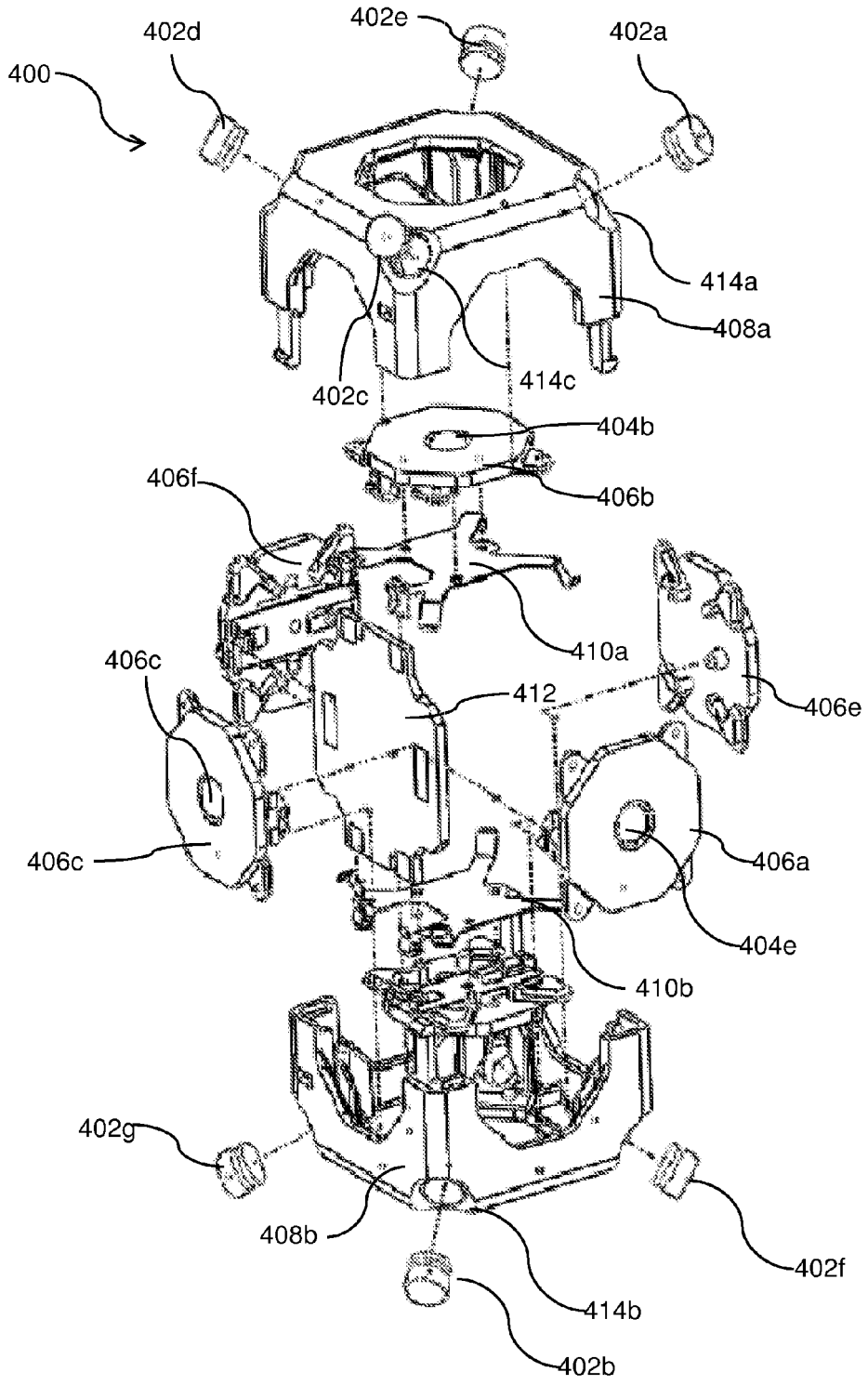

Unit Block (FIGS. 4A-4C)

Figure 4D:
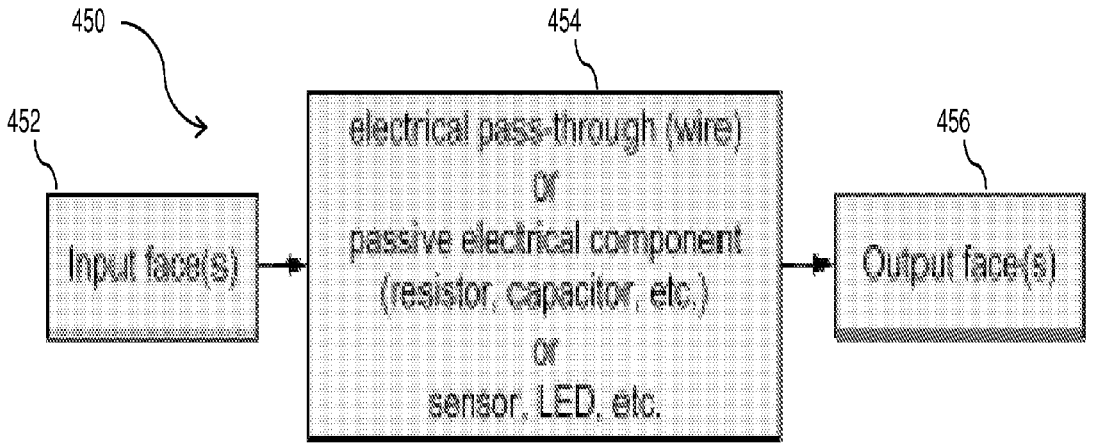
Figure 4E:
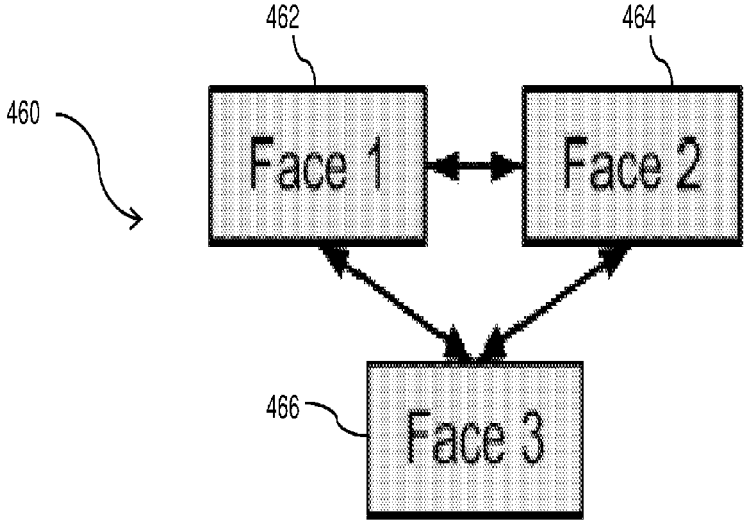

With reference to FIGS. 4A-4C a unit block 400 is shown. The unit (or basic) block 400 is one of the primary building components associated with aspects of the present invention and is designed to be one of the more versatile components used in connection with aspects of the present invention. In the embodiments of FIGS. 4A-4C, FIG. 4 shows a complete and assembled unit block 400, FIG. 4B shows the same block 400 with the exterior base halves 408*a* and 408*b* removed, so that the internal assembled construction is shown, and FIG. 4C shows an exploded assembly drawing of the same unit block 400. Generally speaking, the figures that follow and that reference various other block are presented in a similar manner. Each face 406*a*-406*f* of the unit block 400 may or may not have an electrical contact 404*a*-404*f*, leading to ten different possible combinations of contact and blank faces (excluding rotationally equivalent configurations). Internally, the faces that do include face contacts may be easily wired together internally in any configuration of connections or with other electrical components. In most situations, a printed circuit board is included within the block that contains each of the electrical elements. FIGS. 4D and 4E show two connection and flow diagrams that may be associated with the unit block 400. With reference to FIG. 4D, a schematic diagram 450 is shown that represents a block with some level of function. One or more input faces are represented as element 452 and one or more output faces are represented as element 454. Element 456 represents various embodiments of the internal components that may be found within the block and that reacts to the input obtained through the face(s) 452. For example, element 450 could be a passive electrical component such as a resistor or capacitor or it could be a sensor or LED that is adapted to take the power input from the input face(s) 452 and output them to the output face(s) 454. While FIG. 4D may represent a situation where there is a simple pass through wire within element 454, FIG. 4E more appropriately represents such a situation where each of the faces 462, 464 and 466 are connected only by a conductor and serve to pass through a signal (power or data) from one face to the other. While only three faces are represented in FIG. 4E, the same schematic representation may apply to a block with more than three faces.

With continuing attention to FIGS. 4A-4C, the unit block 400, at each corner of the block 400 is a recessed portion 414*a*-414*h* that is shaped and adapted to receive a corresponding corner magnet 402*a*-402*h*. Conductive spheres, such as spheres 104*a*-104*f* shown in FIG. 1, are received within one or more of the magnet recesses 414*a*-414*h*. Also shown in FIG. 4B are two ground bases 410*a* and 410*b* that serve to electrically interconnect each of the face contacts 404*a*-404*f* together and allow any of the face contacts 404*a*-404*f* to provide an electrical ground to an assembled system. A printed circuit board 412 is mounted within the block and houses all of the electrical components. In the case of the unit block 400, the electrical components are simply a series of conductive wires on the circuit board that connect the 6 faces together in a ground mesh.

Figure 5A:
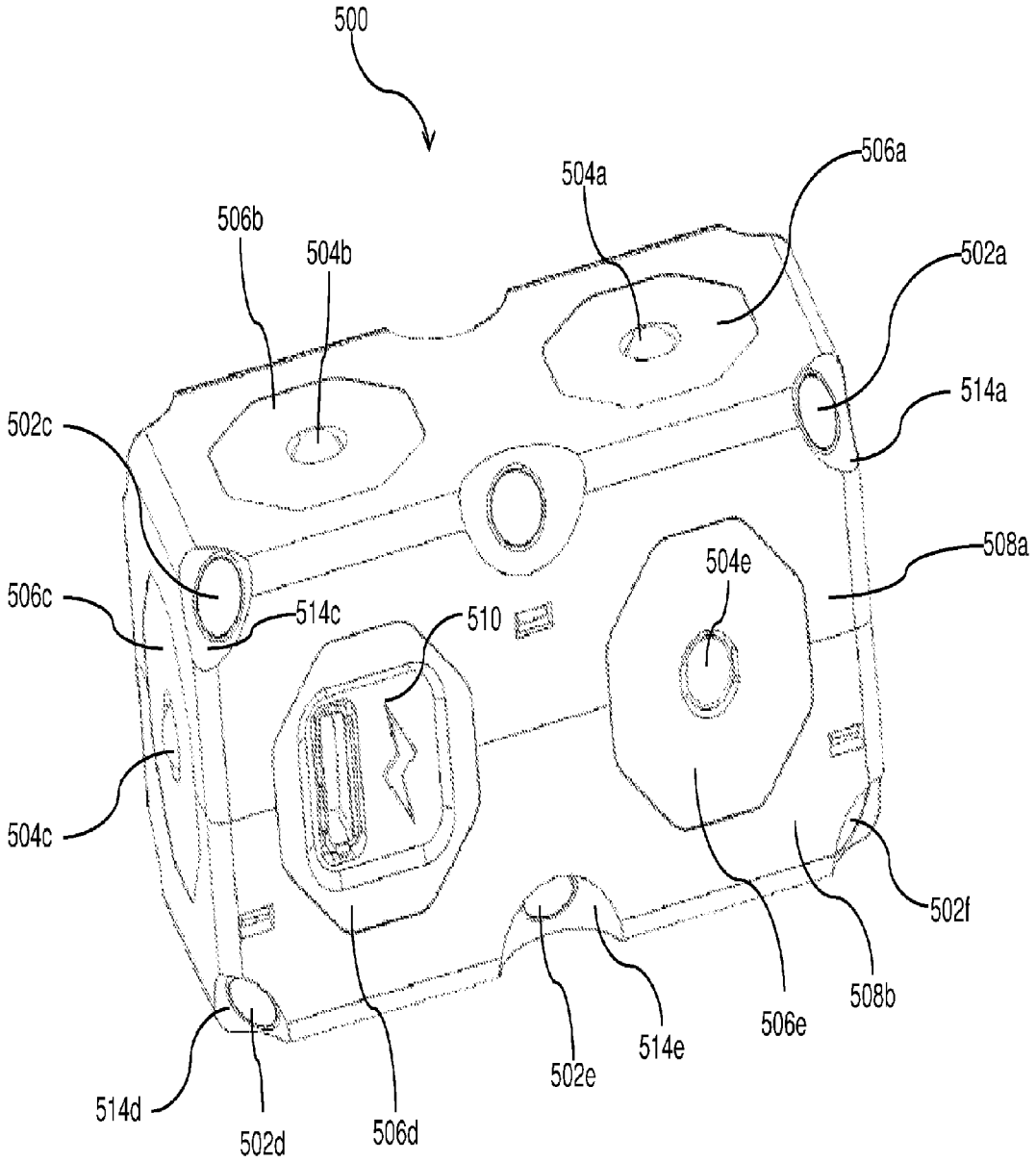
FIGS. 5A-5D show one embodiment of a battery block in accordance with aspects of the present invention.
Figure 5B:
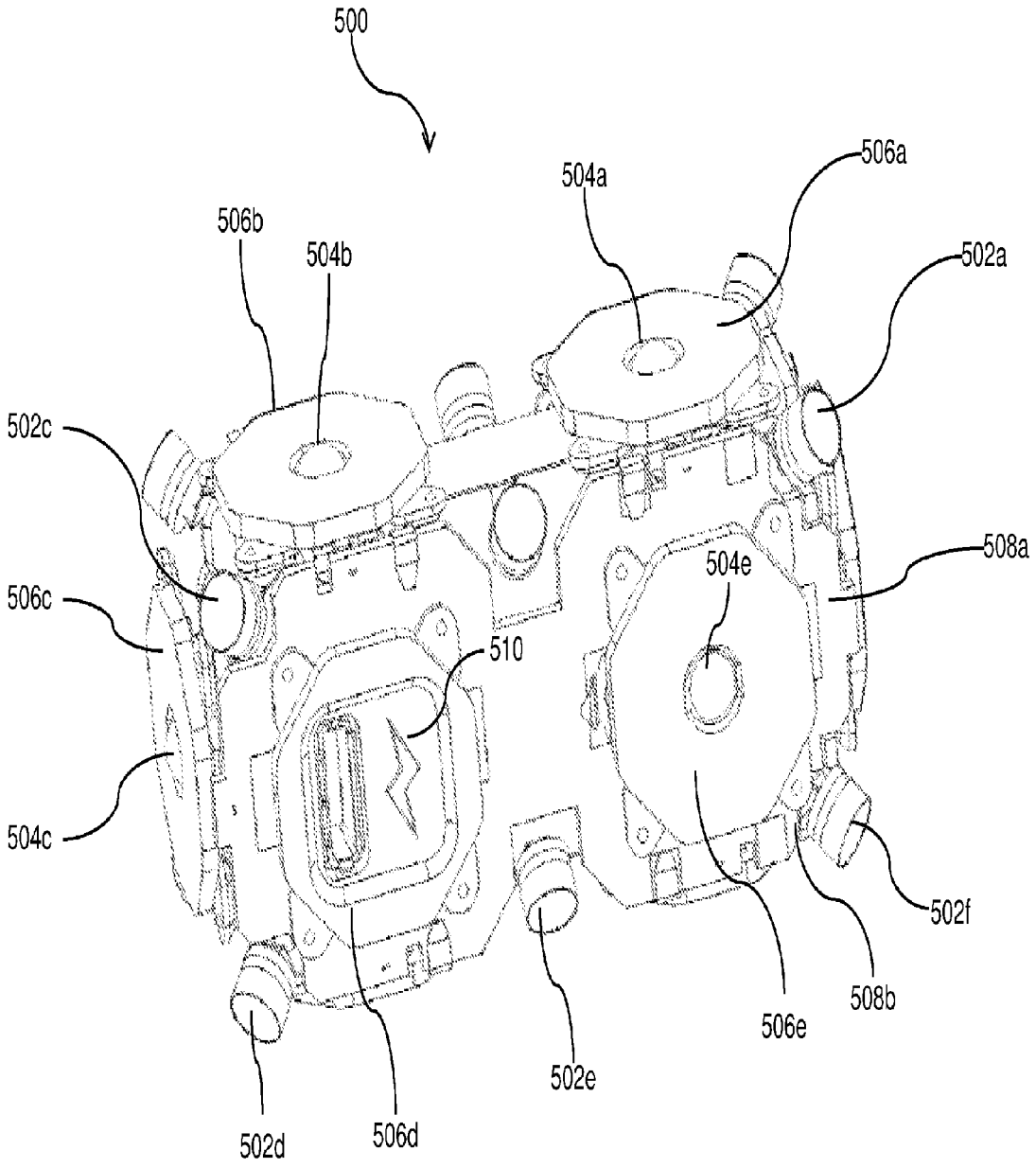
Figure 5C:
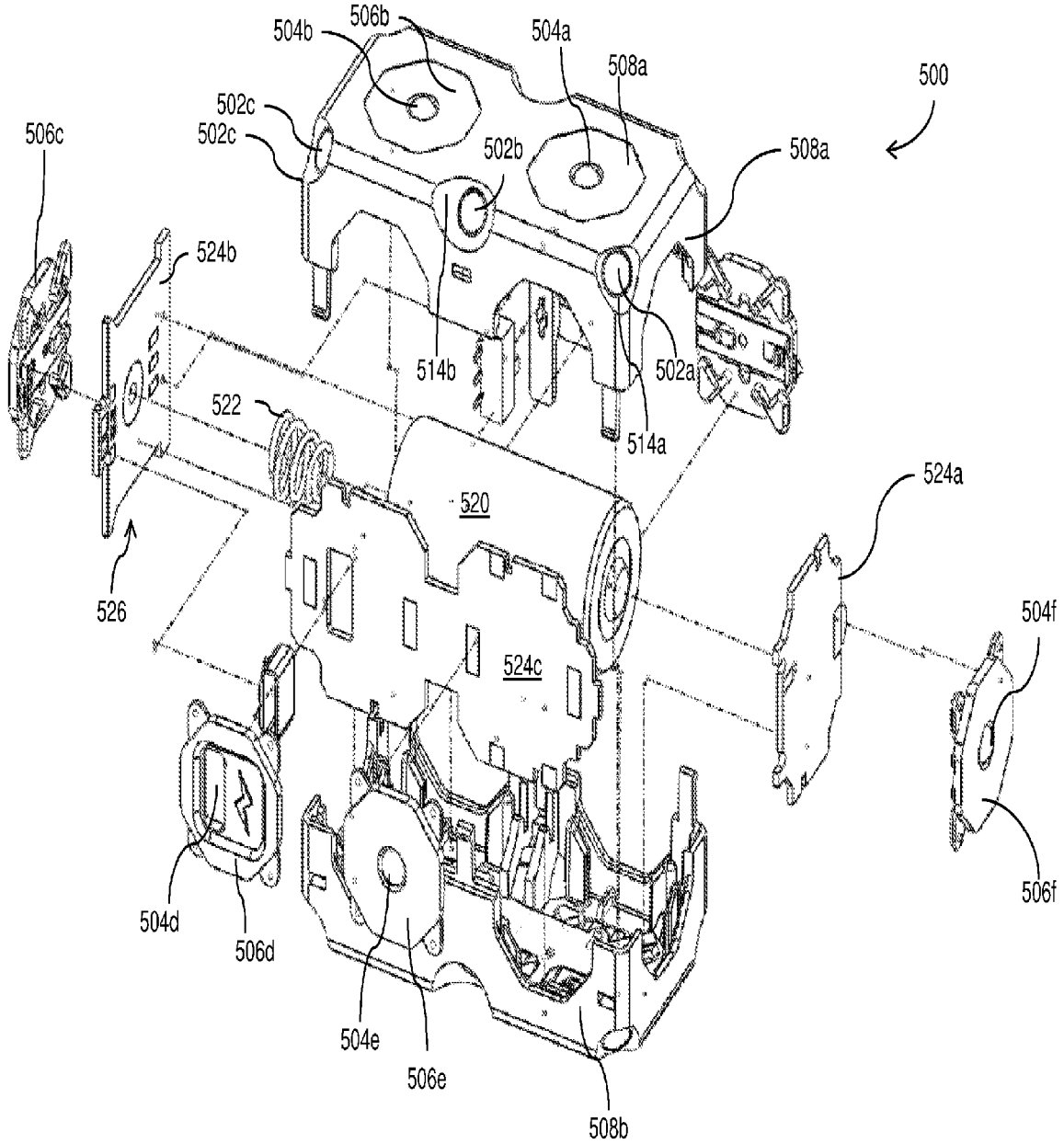

Battery Block (FIGS. 5A-5C)

Figure 5D:
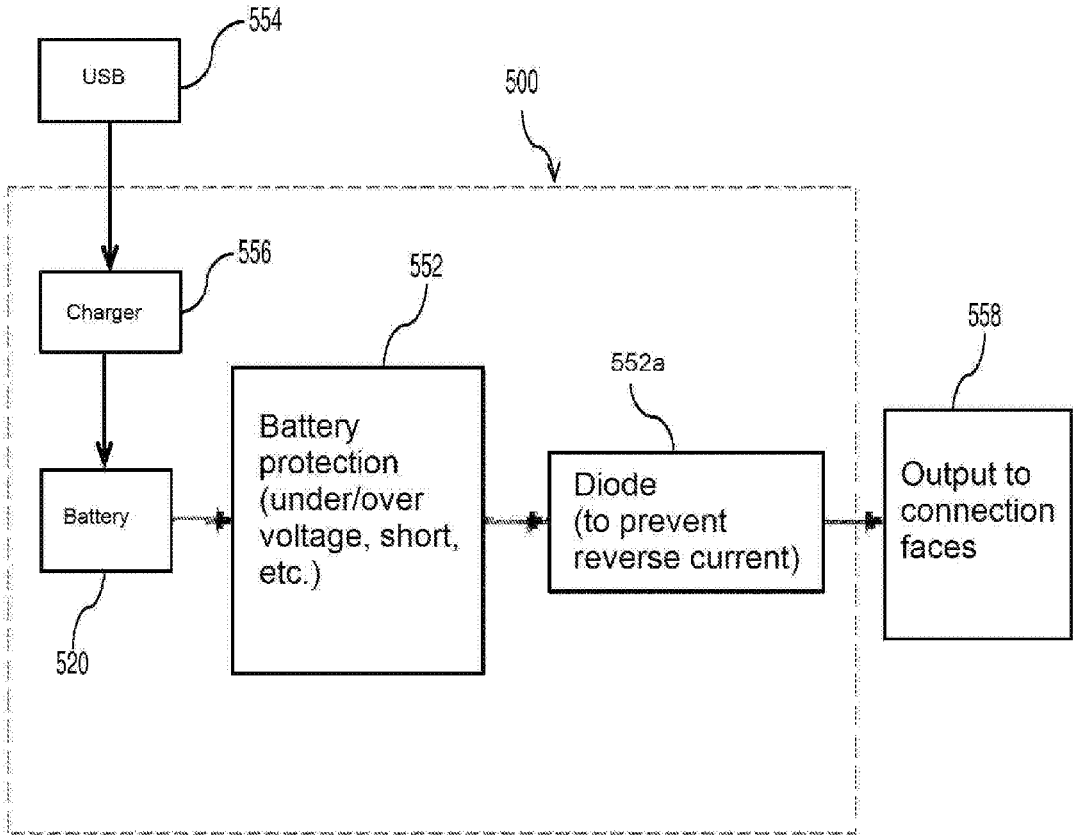

With reference to FIGS. 5A-5C a battery block 500 is shown. The battery block 500 generally provides power to any assembly made with one or more of the components disclosed herein. As shown in FIG. 5A, the battery block 500 is 1×1×2 in size when referenced to the unit block 400. One reason for this increased size is to fit a standard CR 123A LiFePO4 rechargeable battery and the associated circuitry. In FIG. 5C, the battery is labeled as reference number 520. Internal circuits contained on printed circuit boards 524*a* and 524*b* provide protection from shorts occurring anywhere in the completed assembly. There is also an under-voltage cutoff provided in the battery circuitry 526 located on printed circuit board 524*b*. Multiple battery blocks may be provided together in any construction in order to increase the available power and longevity. Each of the contacts 504*a*-504*j* provided in the battery block act like the equivalent of a power plug that can supply power to motors, think blocks, or any of the other blocks and modules described herein that require or can utilize power. Because battery block 500 has a doubled form factor from that of unit block 400, there are ten magnet recesses 504*a*-514*j*, and ten corner magnets 402*a*-402*j*, although four of those magnets are not accurately described as being at "corners" since they are disposed on the length of one of the face edges. Battery block 500 also includes ten faces 506*a*-506*j* and ten associated face contacts 504*a*-504*j*. In the embodiment shown in FIGS. 5A-5C, face 504*d* is a power contact and includes USB port 504*d* for allowing communication and/or power charging of the battery block 500. Spring contact 522 engages the battery 520 with the electrical circuitry 526 of the battery block. Printed circuit boards 524*a*, 524*b* and 524*c* provide the internal electronic components for the battery module 500. FIG. 5D shows a flow diagram 550 that may be associated with the battery block 500. One or more output face(s) is represented as element 558. Internal to the battery block 500 is a charger element 556, the battery itself 520 and battery protection circuitry 552. Protection circuitry 552 may include short circuit and under/over voltage protection as well as a reverse current protection circuit 552*a*. A USB or other connection 554 may be included for recharging the battery 520.

Figure 6A:
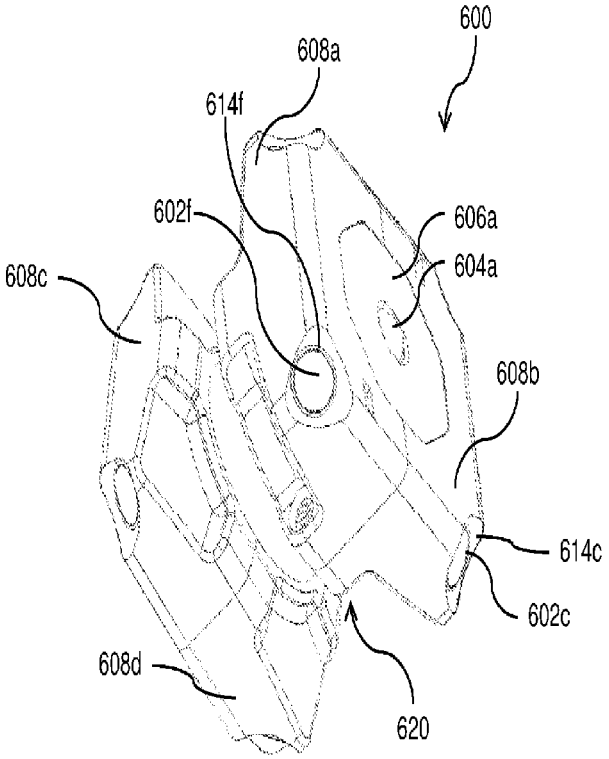
FIGS. 6A-6D show one embodiment of a bearing block in accordance with aspects of the present invention.
Figure 6B:
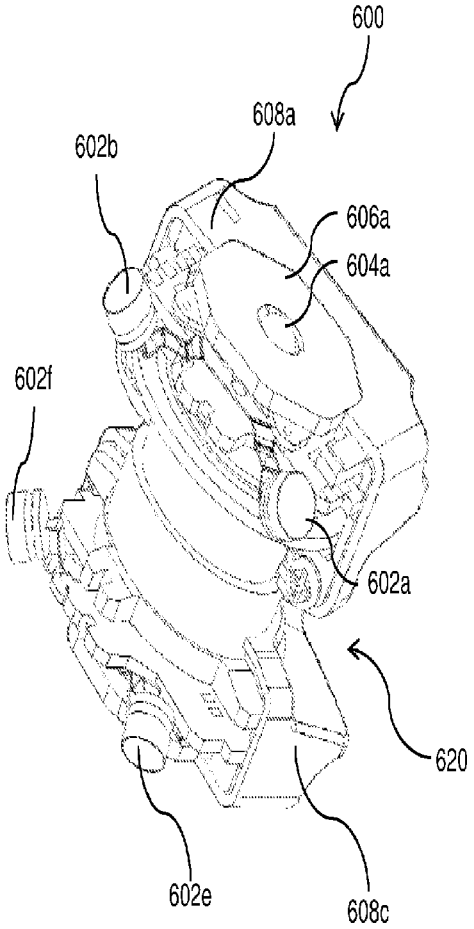
Figure 6C:
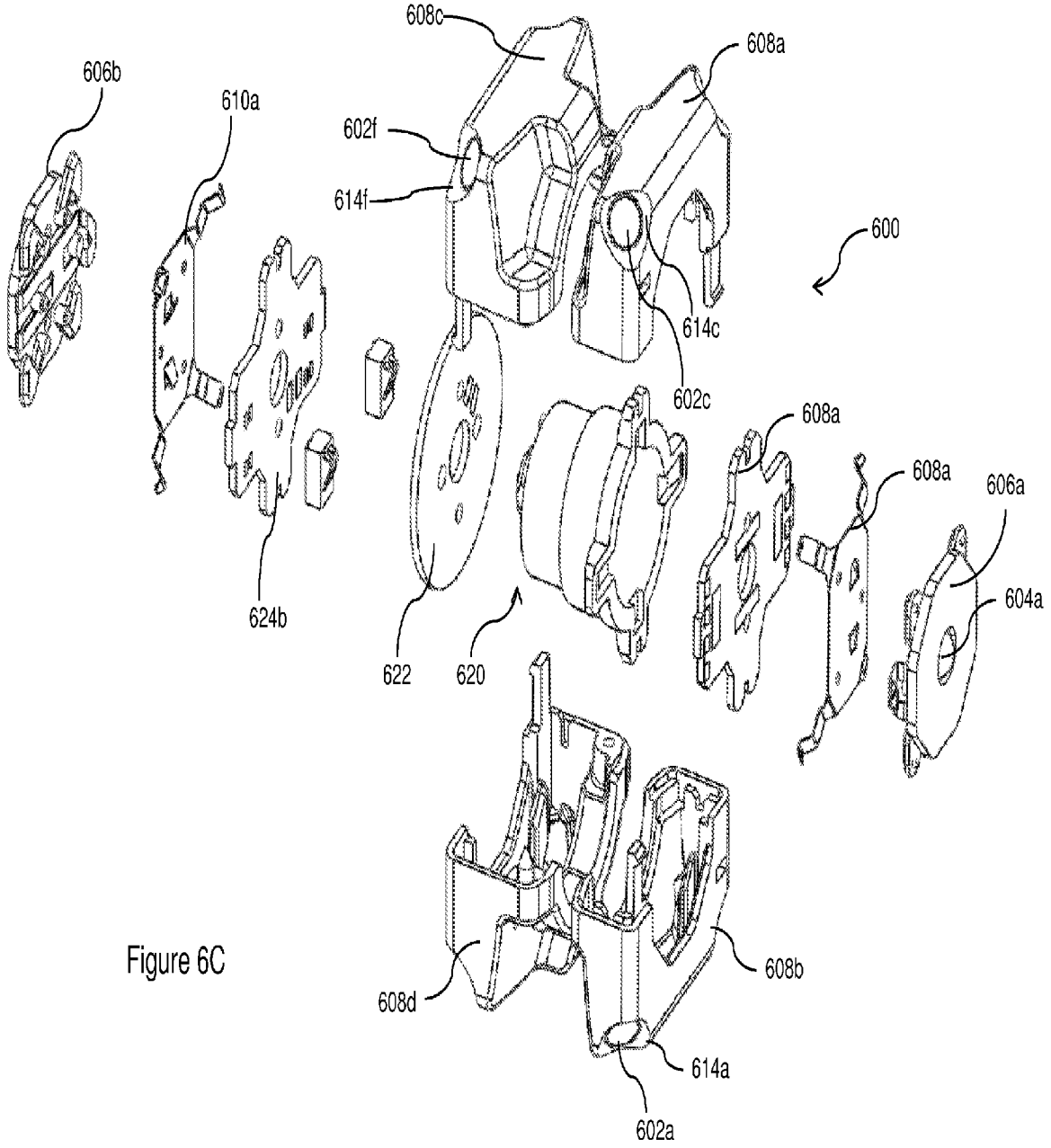

Bearing Block (FIGS. 6A-6C)

Figure 6D:
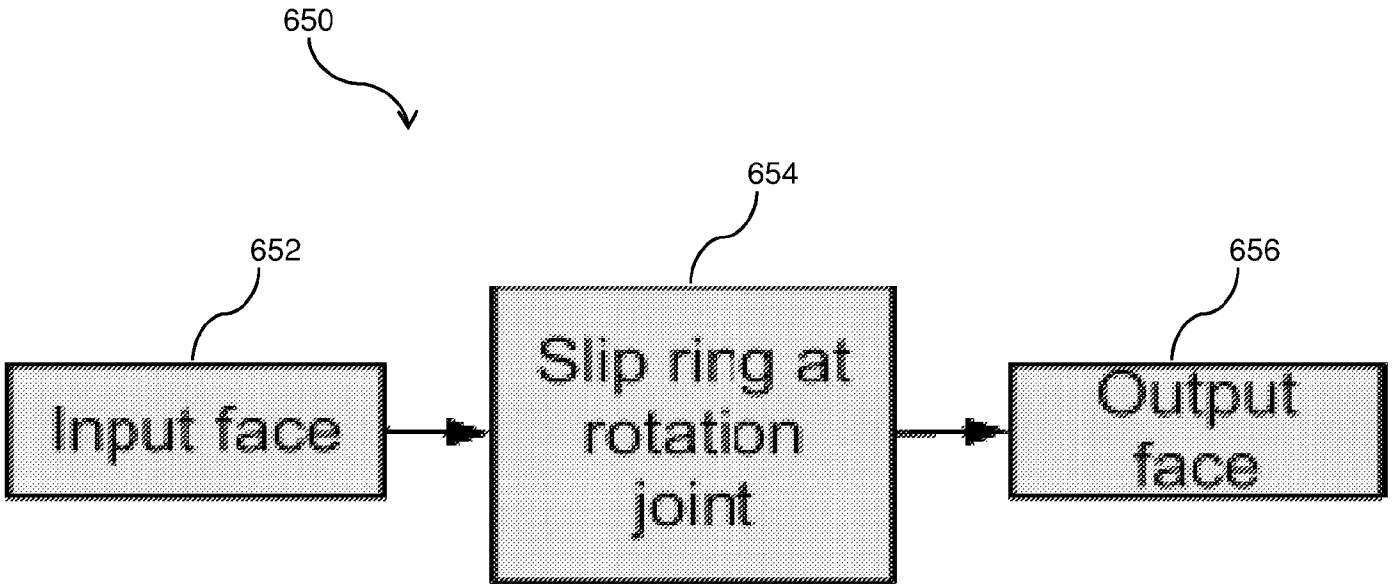

With reference to FIGS. 6A-6C a bearing block 600 is shown. Generally speaking a bearing block 600 is a passive block that spins freely about its central axis. Bearing blocks can be used to attach wheels or to provide a second point of connection for rotating parts driven by other blocks such as a continuous rotation block (See FIGS. 7A-7C below). In a preferred embodiment, a slip ring 622 may be utilized to pass a ground and/or a signal through the rotary joint present in the bearing block. Bearing block 600 includes two portions 601*a* and 601*b* that may freely rotate in relation to each other by the provision of a rotation joint 620 connecting the two portions 601*a* and 601*b*. As with the other blocks, bearing block 600 includes several exterior shell halves 608*a*-608*d*, two for each of the portions 601*a* and 601*b*, a magnet recess 614*a*-614*h* at each corner of the portions 601*a* and 601*b* and a corner magnet 602*a*-602*h* for each of the magnet recesses 614*a*-614*h*. Face contacts 604*a* and 604*b* are located on the faces 606*a* and 606*b*. With specific reference to FIG. 6C, more detail of the rotation joint 620 may be seen as well as the two ground bases 610*a* and 610*b* present within the structure of bearing block 600. Circuit boards 624*a* and 624*b* provide the electronic connections and other internal circuitry within the bearing block and slip ring 622 allows data and grounding to be provided through the bearing block 600. FIG. 6D shows a flow diagram 650 that may be associated with the bearing block 600. One or more output face(s) is represented as element 656 and one or more input face(s) is represented as element 652. Internal to the bearing block 650, the components of the slip ring are represented as element 654. Since the bearing block is a mechanical element with no data function, the slip ring 654 is comprised of a pass-through electrical connection with a mechanical solution to allow the bearing block to rotate continuously.

Figure 7A:
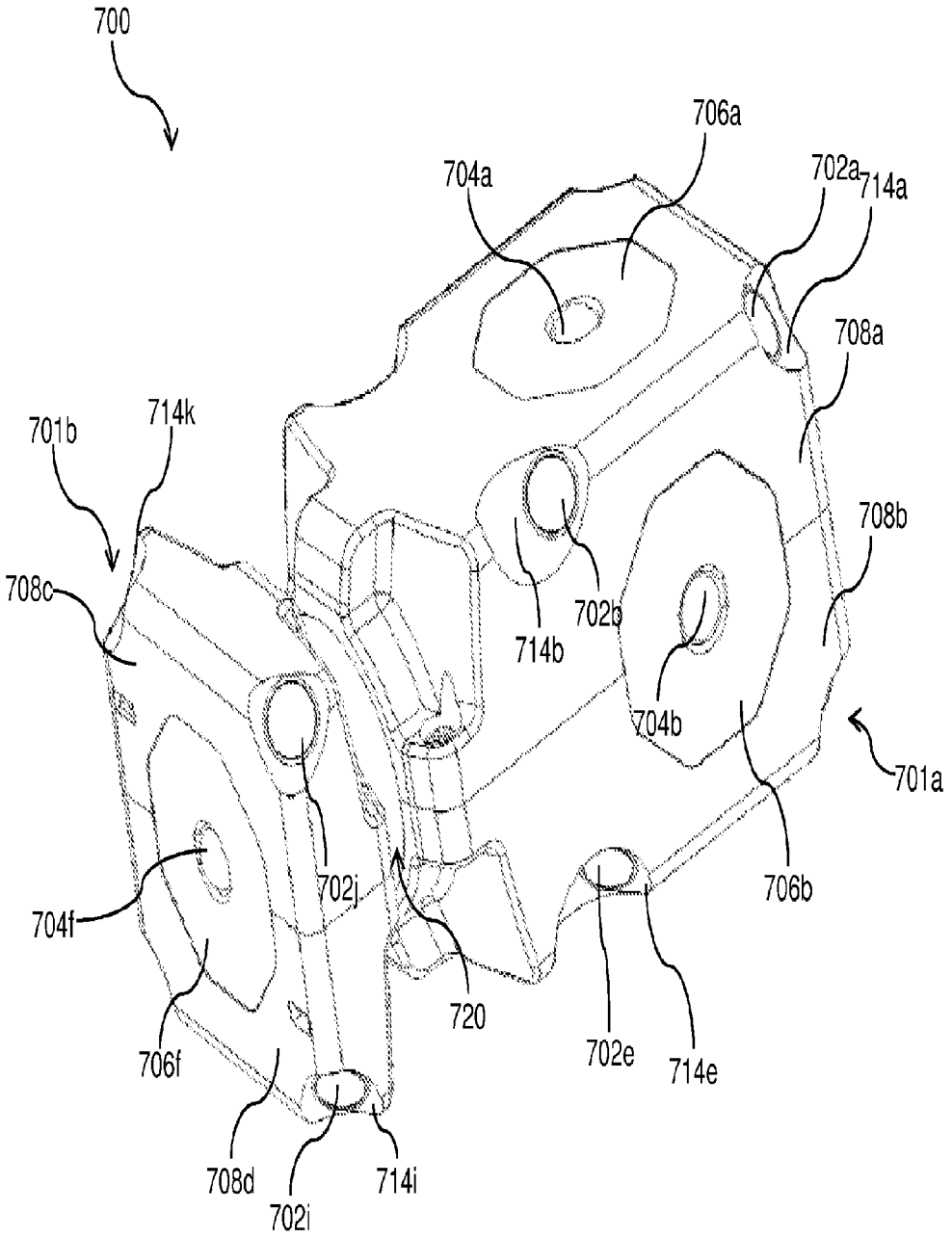
FIGS. 7A-7D show one embodiment of a continuous rotation block in accordance with aspects of the present invention.
Figure 7B:
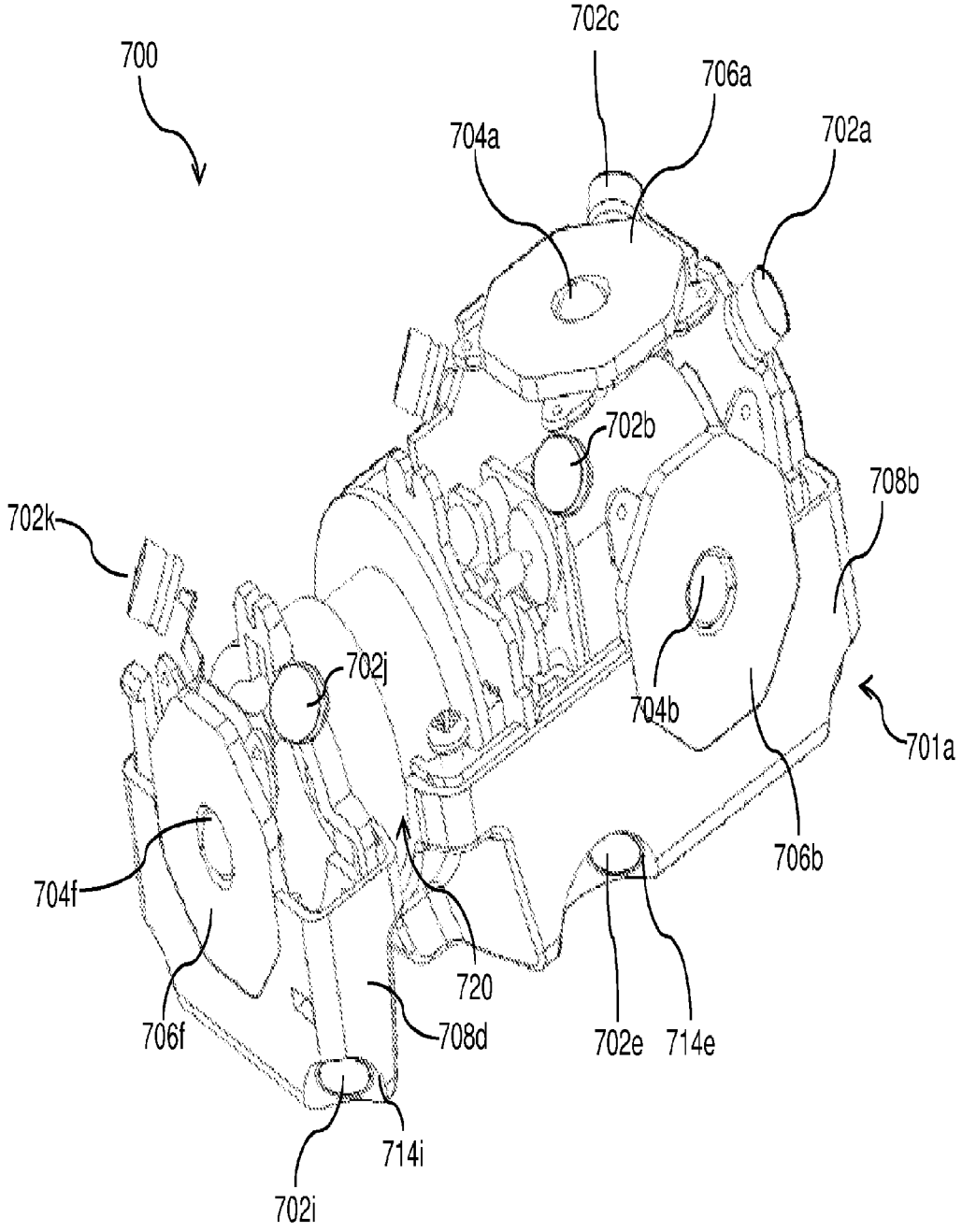
Figure 7C:
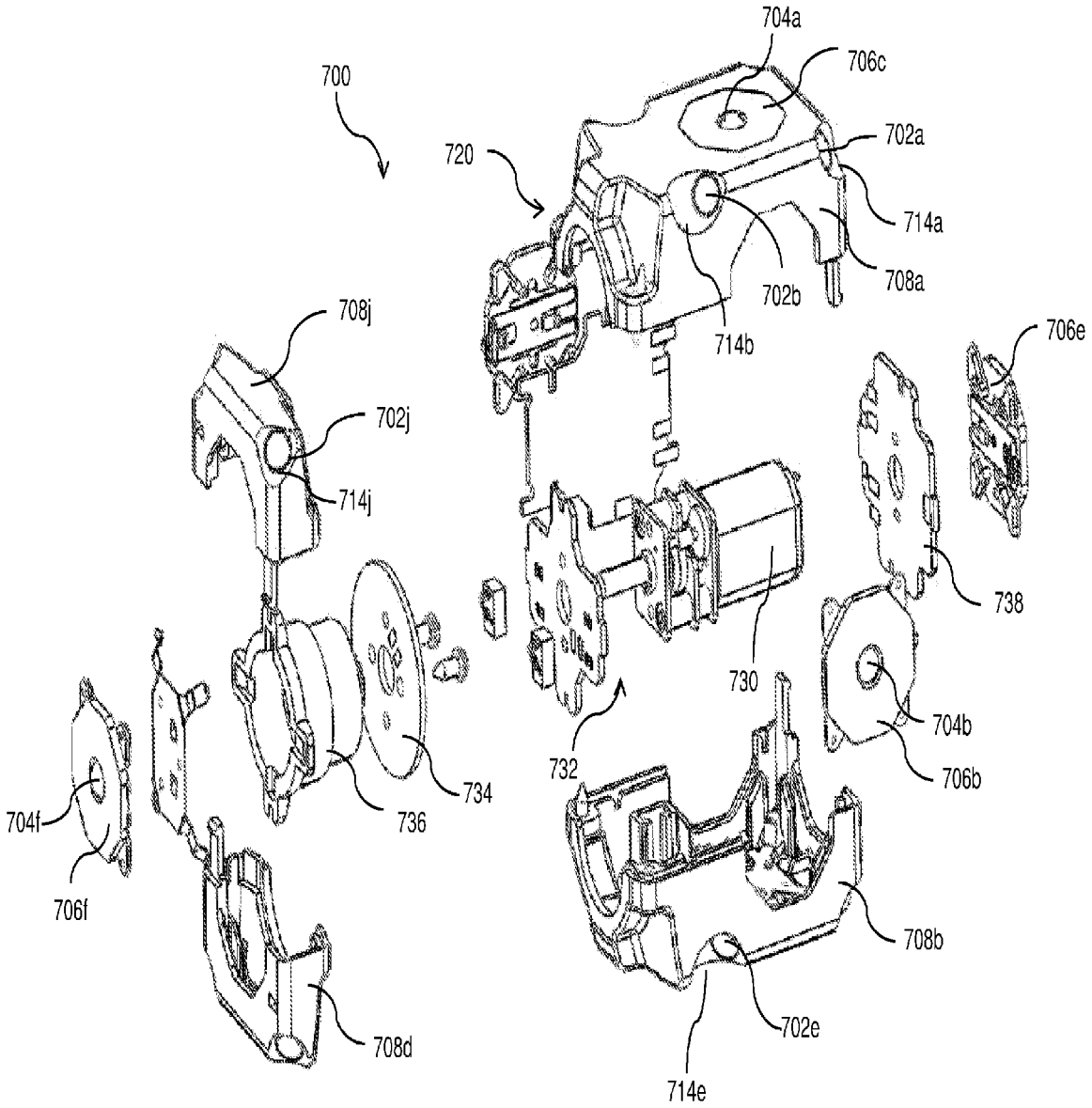

Continuous Rotating Block (FIGS. 7A-7C)

With reference to FIGS. 7A-7C a continuous rotation block 700 is shown. Generally speaking a continuous rotation block 700 enables creations that require angular-velocity controlled motion. For instance, driving the wheels of a vehicle. In accordance with one aspect, the block 700 includes two distinct faces. In a construction, a first power face 701*a* is connected to a battery block which can source enough current to drive the motor. This is analogous to "plugging the motor in." The voltage present on a second face 701*b* controls the angular velocity of the motor. This face can be connected to a think block (See FIG. 11 et seq. below) or another signal source which does not provide a significant amount of current. Internal electronics spin the motor with a speed and/or torque proportional to the control voltage. The continuous rotation block 700 has shell halves 708*a*, 708*b* 708*c* and 708*d* that form the enclosure for the two faces 701*a* and 701*b*. As with other modules and blocks, a magnet recess 714*a*-714*l* at each corner of the portions 701*a* and 701*b* and a corner magnet 702*a*-7021 for each of the magnet recesses 714*a*-714*l*. Face contacts 704*a*-704*f* are located on the faces 706*a*-706*f*. With specific reference to FIG. 7C, more detail of the rotation joint 720 may be seen as well as the motor 730 and a slip ring 734 that allows data and grounding to be provided through the rotating block 700.

Figure 7D:
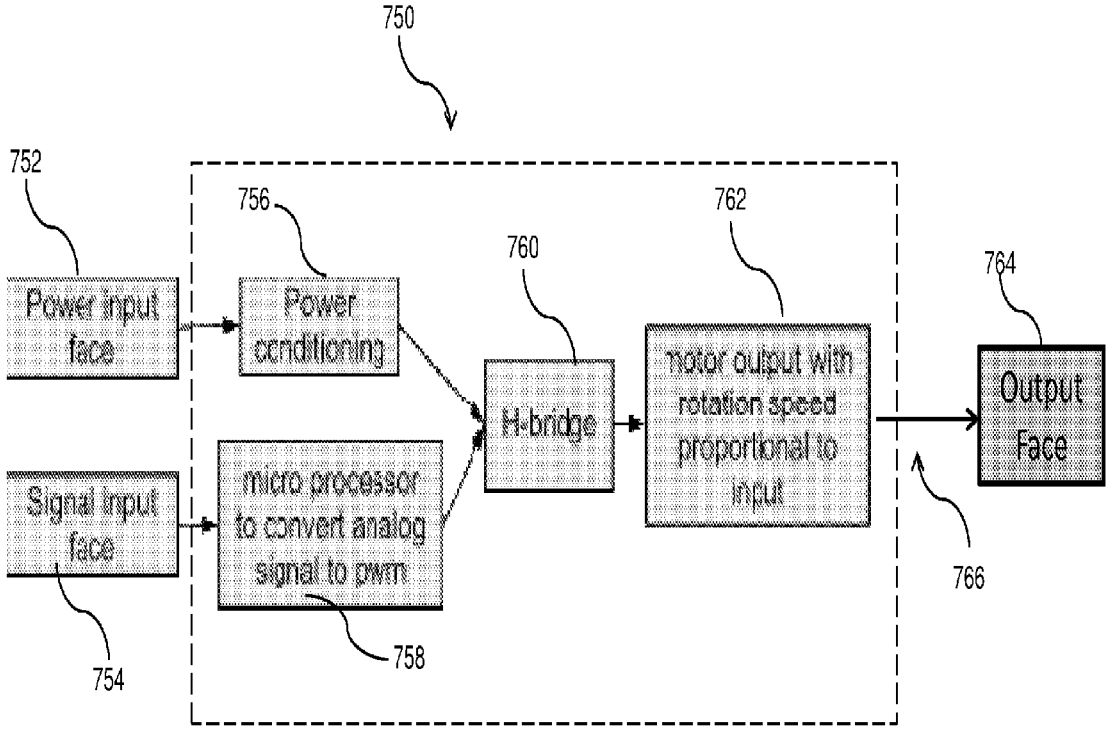

FIG. 7D shows a flow diagram 750 that may be associated with the continuous rotation block 700. One or more output face(s) is represented as element 764. One or more power input faces is represented by element 752 and one or more signal or data input faces is represented by element 754. Internal to the continuous rotation block 700 is a power conditioning element 756, a microprocessor 758, an H-bridge circuit 760 and a motor output 762 that can deliver a rotational speed that is related or otherwise proportional to the input power and signal. The mechanical slip ring is represented as element 766 on flow chart 750. FIG. 7D represents a block that utilizes an analog to digital conversion in order to translate the input power and signal to a signal that can effectively drive the rotational movement at output face 764.

Figure 8A:
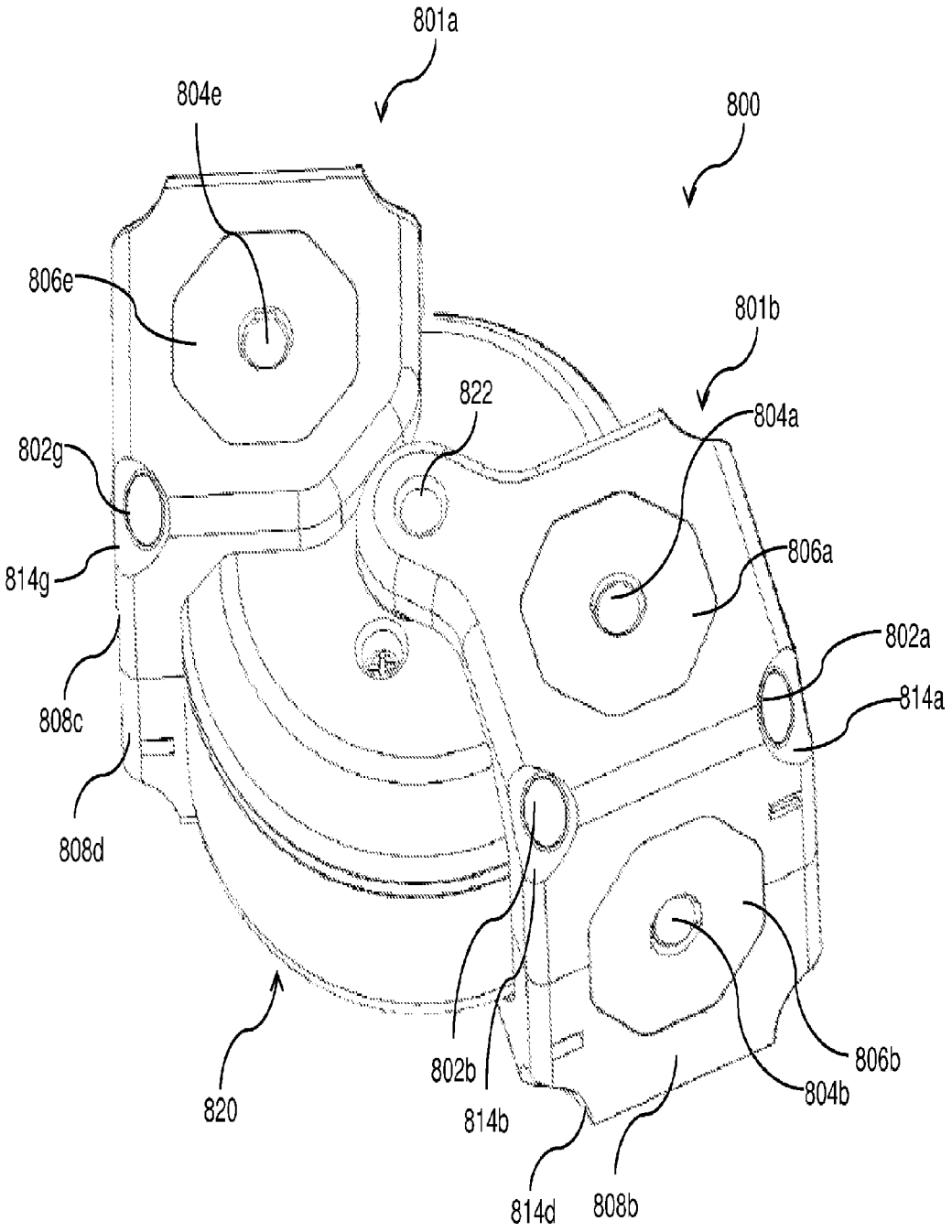
FIGS. 8A-8D show one embodiment of an angle servo block in accordance with aspects of the present invention.
Figure 8B:
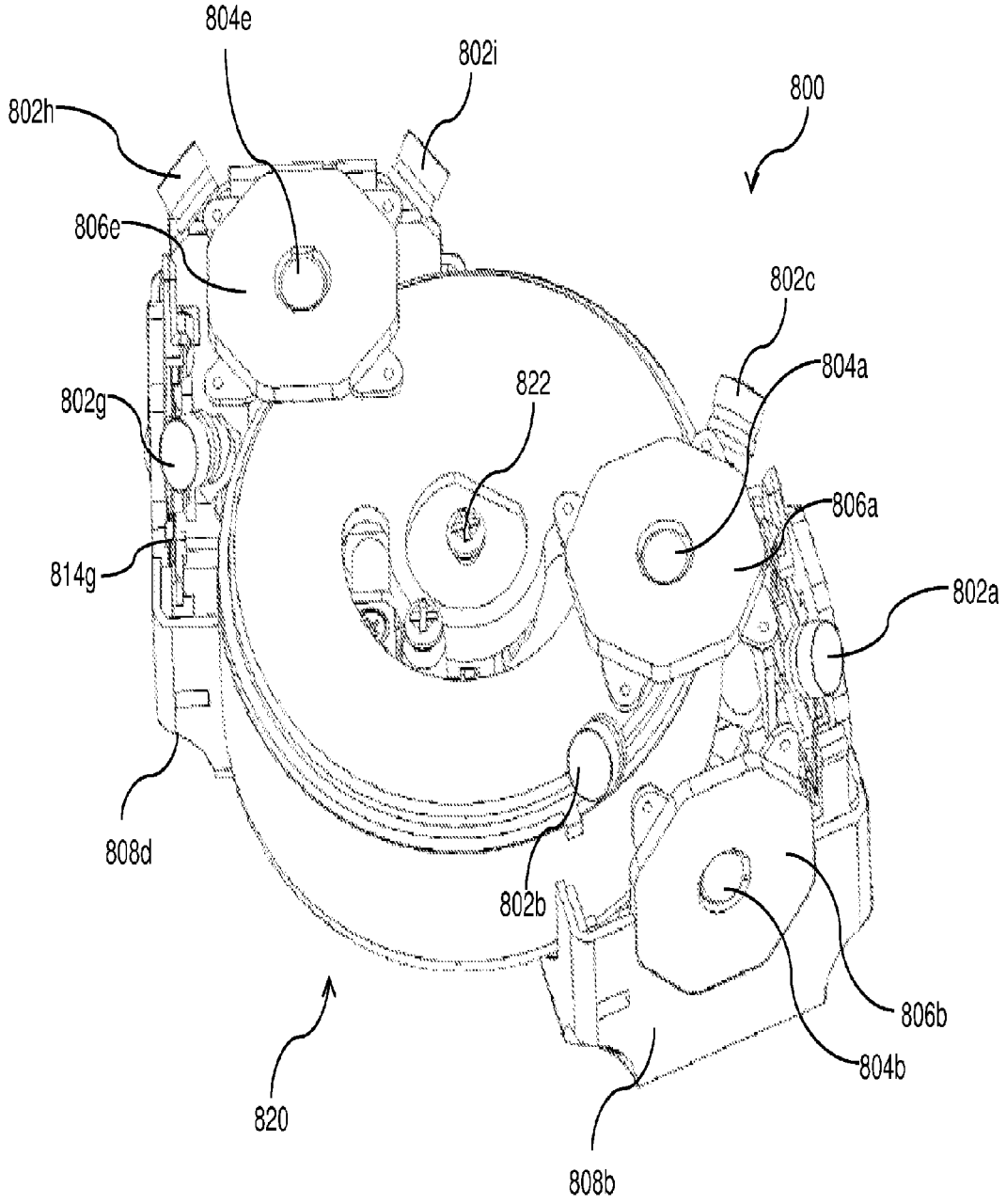
Figure 8C:
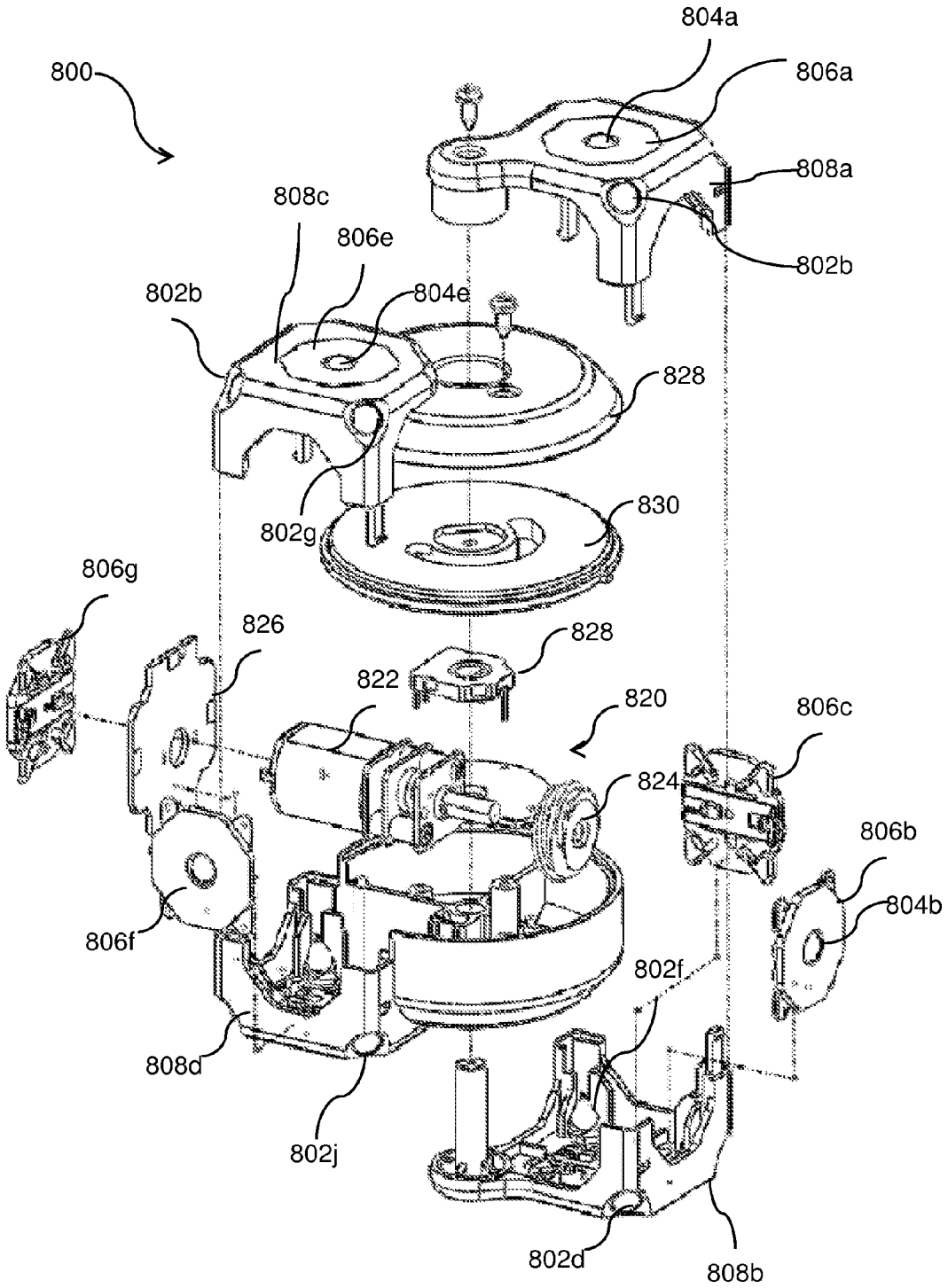

Angle Block (FIGS. 8A-8C)

With reference to FIGS. 8A-8C an angle block 800 is shown. Generally speaking, the angle servo block 800 rotates to an angle proportional to its input voltage. This block also takes two distinct inputs (power and signal) on two distinct sets of one or more faces. In this case, closed loop control drives the angle between the two sections of this block. This block is fundamental to most robotic creations as the movement created by the angular motion capabilities allows complex motion in the constructions such as an arm or leg might move in an automaton type design Like the other motor blocks, connecting the power face to a source capable of delivering the required current is necessary. Angle block 800 includes a generally fixed position portion 801*a* and an angular motion portion 801*b* connected by a connecting portion 820 that translates a rotation motion generated by an internal motor 822 into the angular motion contemplated by this module. As with the other modules, each of the portions 801*a* and 801*b* include shell halves 808*a*, 808*b*, 808*c* and 808*d* that enclose the corresponding portions 801*a* and 801*b*. A magnet recess 814*a*-814*l* at each corner of the portions 801*a* and 801*b* and a corner magnet 802*a*-802*l* for each of the magnet recesses 814*a*-814*l*. Face contacts 804*a*-804*h* are located on the faces 806*a*-806*h*. Rotational connecting portion 820 includes a rotation point 822 that allows portion 801*b* to rotate about the axis defined by rotation point 822. With reference to FIG. 8C, further detail of the internal structure of the module 800 is shown including the mechanism for translating rotation motion generated by the motor 822 into angular motion. The structure within 820 include a worm gear 824 that couples with a threaded plate 830. As the motor spins the worms gear 824 the threads engage with the plate 830 and rotates the plate and portion 801*b* accordingly. A printed circuit board 826 includes the appropriate electronic components and potentiometer 828 provides feedback to the control loop.

Figure 8D:
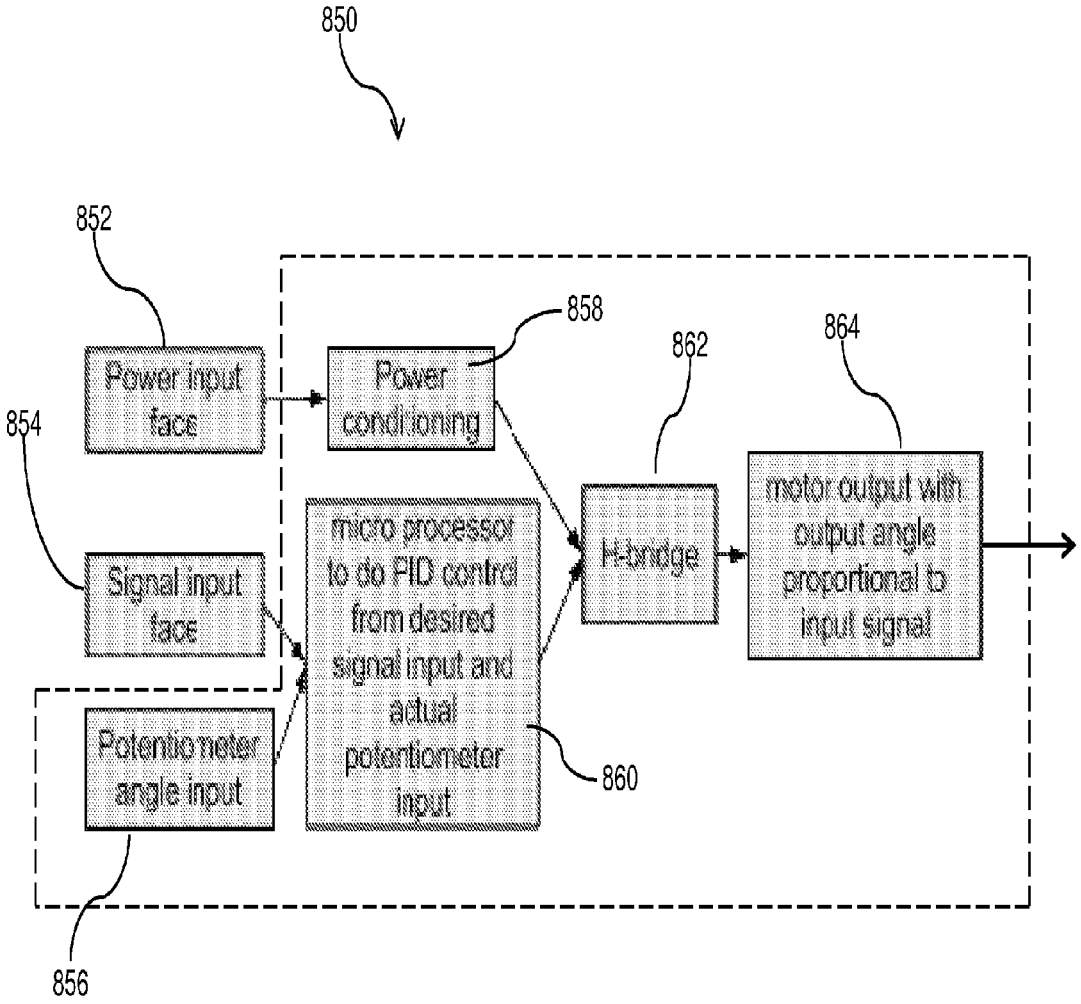

FIG. 8D shows a flow diagram 850 that may be associated with the angle block 800. One or more power input faces is represented by element 852 and one or more signal or data input faces is represented by element 854. Also shown is an input 856 corresponding to a potentiometer input that is internal to the block and monitors the current angle formed by the block. Also internal to the angle block 800 is a power conditioning element 858, a microprocessor 860, an H-bridge circuit 862 and a motor output 864 that can deliver an output angle proportional to the input signal. FIG. 8D represents a block that utilizes an analog to digital conversion in order to translate the input power, signal and variable angle input to a signal that can effectively move the output face 868 a desired angular distance.

Figure 9A:
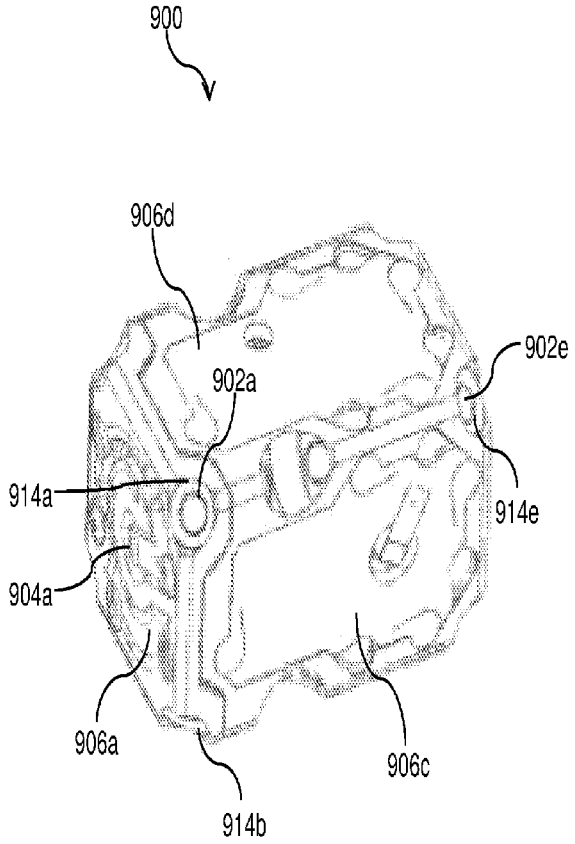
FIGS. 9A-9D show one embodiment of a linear extension servo block in accordance with aspects of the present invention.
Figure 9B:
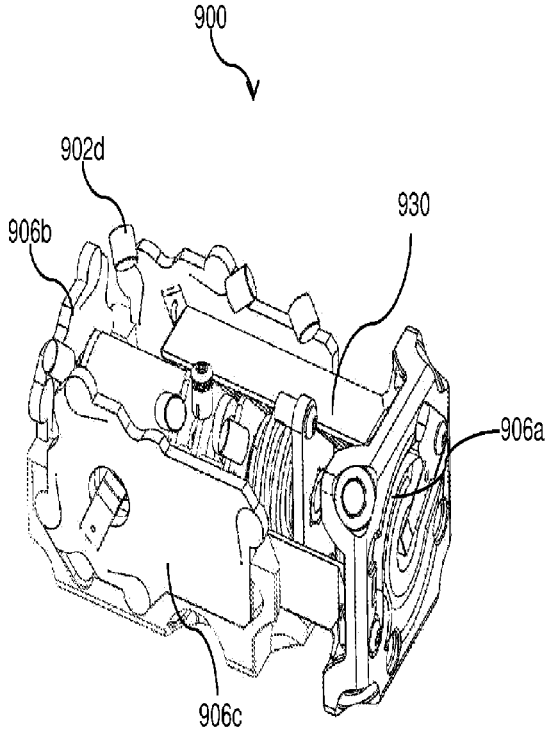
Figure 9C:
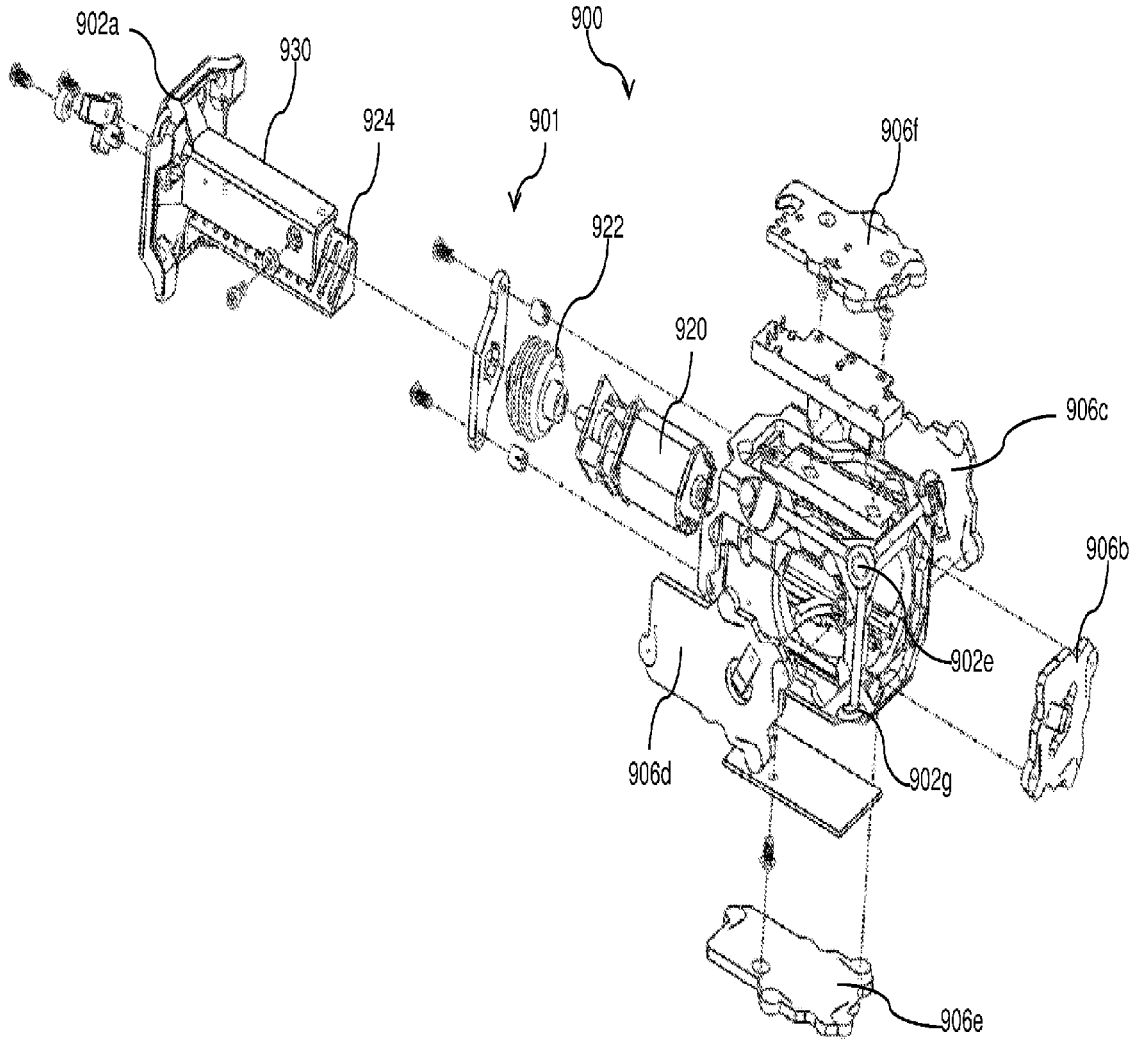

Linear Extension Block (FIGS. 9A-9C)

With reference to FIGS. 9A-9C, a linear extension block 900 is shown. In one embodiment, this block extends and contracts by up to 40% from its nominal two module-unit length. In another embodiment, this block can extend and contract by up to 70% from its base length by the use of telescoping internal portions. Like the angle block described above, the linear extension block operates under servo control and moves to a position proportional to the input signal voltage. Also like the other motor blocks, connecting the power face to a source capable of delivering the required current is necessary. The linear extension block 900 includes magnet recesses 914*a*-914*h* at each corner and a corner magnet 902*a*-902*h* for each of the magnet recesses 914*a*-914*h*. Face contact 904 is located on the face 906*a*. A linear motion translation system 901 includes a motor 920 that translates rotational motion into linear motion. The linear motion system 901 includes a threaded worm gear 922 that couples with a threaded plate 924. As the motor 920 spins the worm gear 922 the threads on the worm gear engage with the threads on the plate 924 and moves an extension arm 930 in a linear direction accordingly.

Figure 9D:
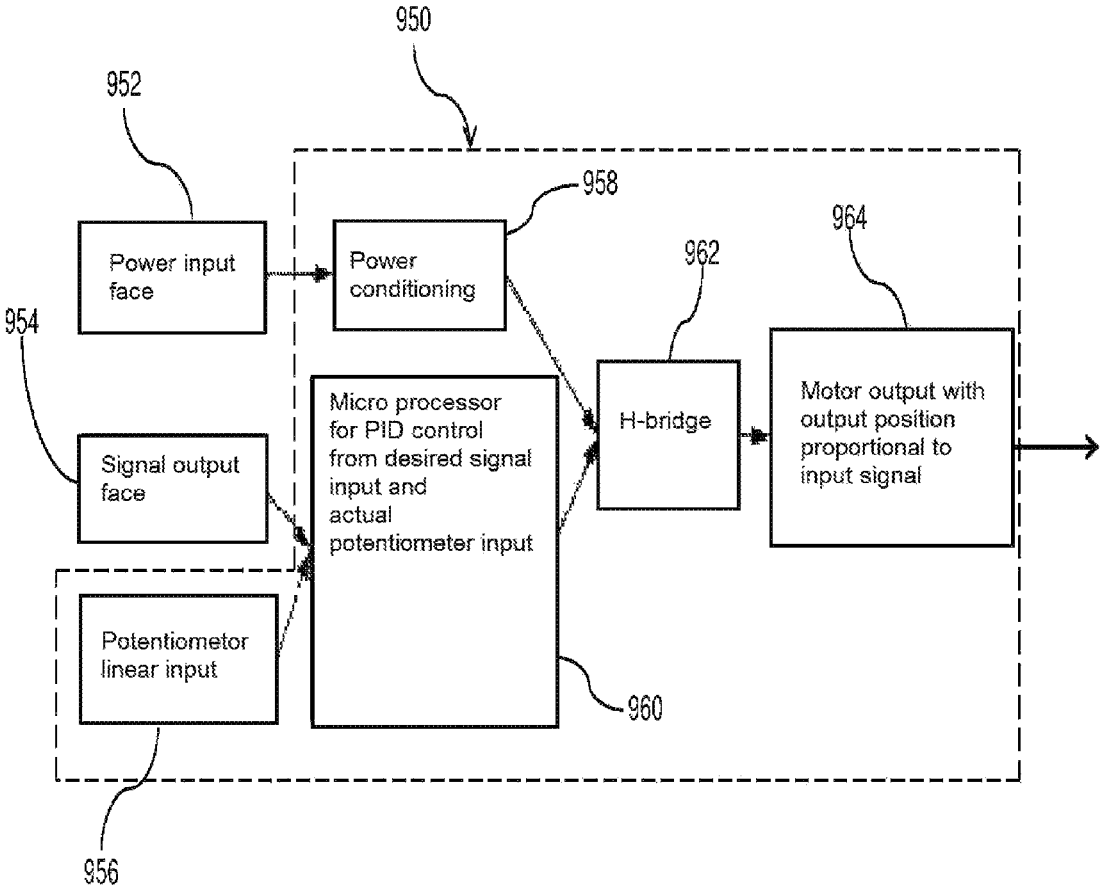

FIG. 9D shows a flow diagram 950 that may be associated with the linear extension block 900 (see e.g. FIG. 9C). One or more power input faces is represented by element 952 and one or more signal or data input faces is represented by element 954. Internal to the linear extension block 900 is a power conditioning element 958, a microprocessor 960, an H-bridge circuit 962 and a motor output 964 that can deliver an output position proportional to the input signal. FIG. 9D represents a block that utilizes an analog to digital conversion in order to translate the input power, signal and variable angle input to a signal that can effectively move the output face 868 a desired linear distance.

Figure 10A:
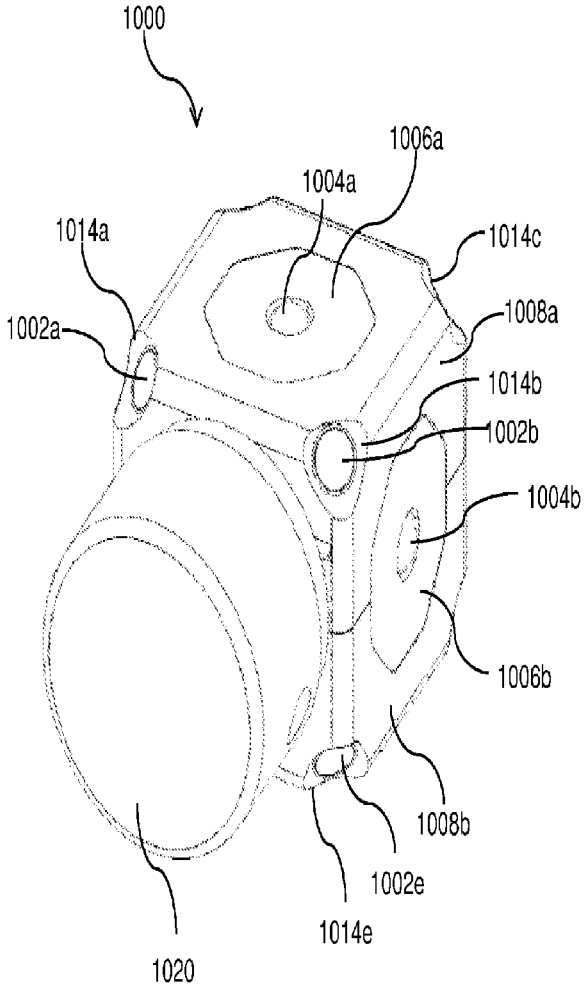
FIGS. 10A-10D show one embodiment of a knob block in accordance with aspects of the present invention.
Figure 10B:
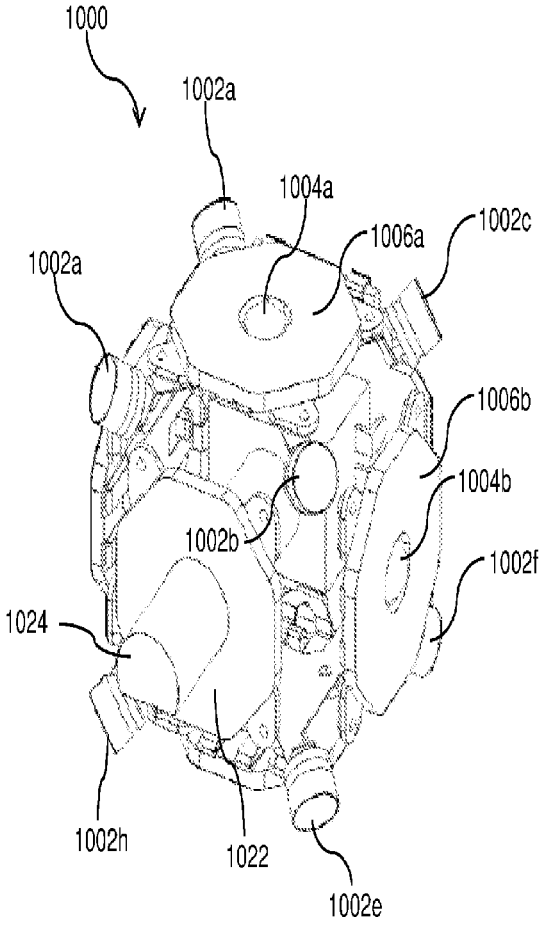
Figure 10C:
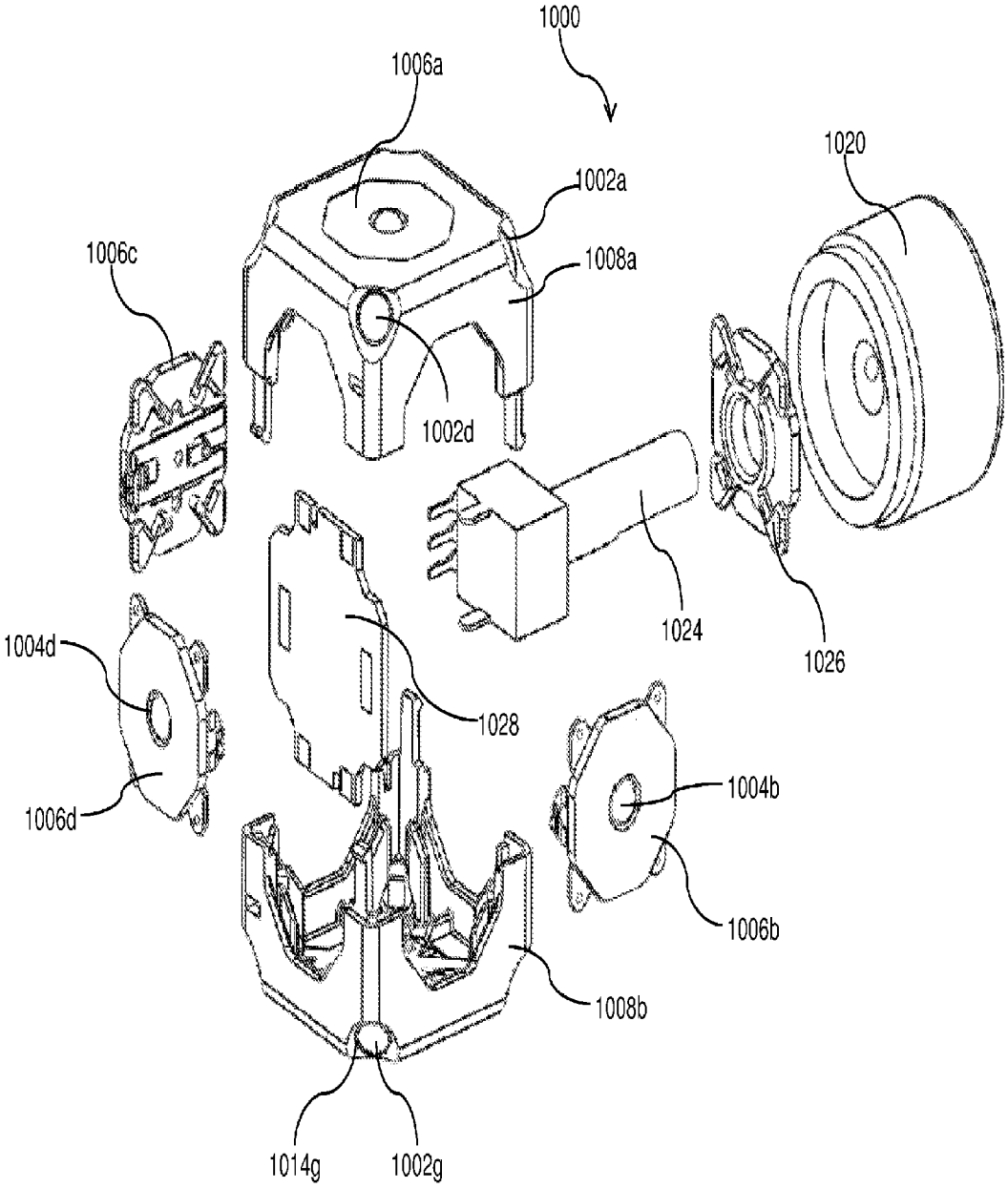

Knob Block (FIGS. 10A-10C)

With reference to FIGS. 10A-10C, a knob block 1000 is shown. The knob block outputs a signal proportional to the input voltage scaled by the relative position of the knob. This block can simply be connected to the battery block on one face, then the knob twisted to output the full range of analog signal on the output face. As with the other blocks, the knob block 1000 includes shell halves 1008*a* and 1008*b*, magnet recesses 1014*a*-1014*h* at each corner and a corner magnet 1002*a*-1002*h* for each of the magnet recesses 1014*a*-1014*h*. Face contacts 1004*a*-100*e* are located on each of the faces 1006*a*-1006*e*. A control knob 1020 is connected to a potentiometer arm 1024 and acts to scale the input voltage that gets output from the knob block 1000. Printed circuit board 1028 contains the applicable electronics that are present within the knob block 1000.

Figure 10D:
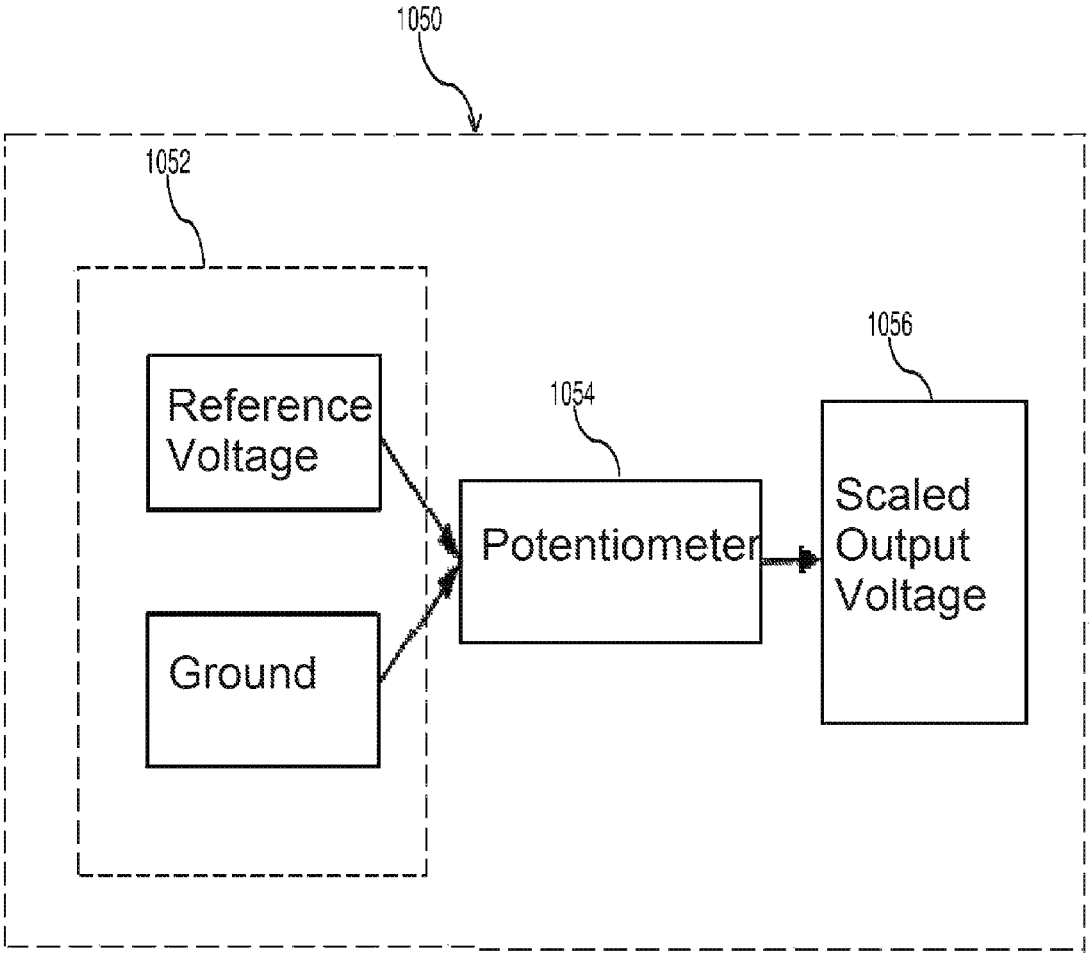

FIG. 10D shows a flow diagram 1050 that may be associated with the knob block 1050. One or more power input faces is represented by element 1052. Functionally internal to the knob block 900 but easily accessible to the user is a potentiometer element 1054 that can deliver a scaled output voltage 1056 to one or more output faces 1054.

Figure 11:
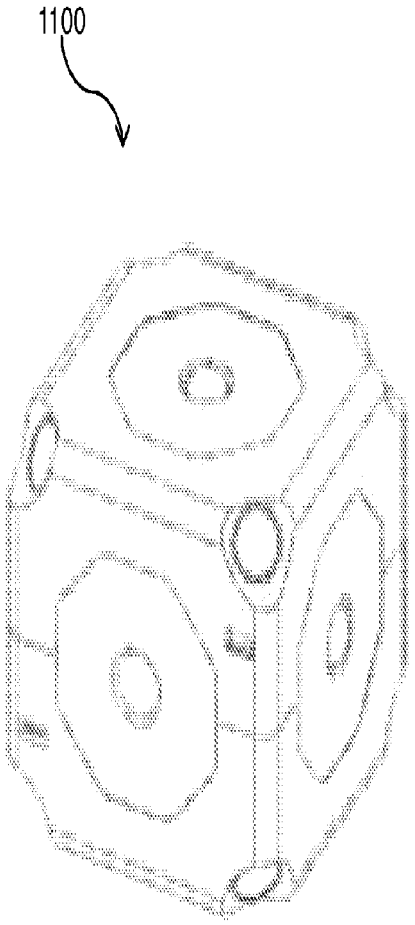
FIG. 11 shows one embodiment of a think block in accordance with aspects of the present invention.

Brain/Think Block (FIG. 11)

Figure 11C:
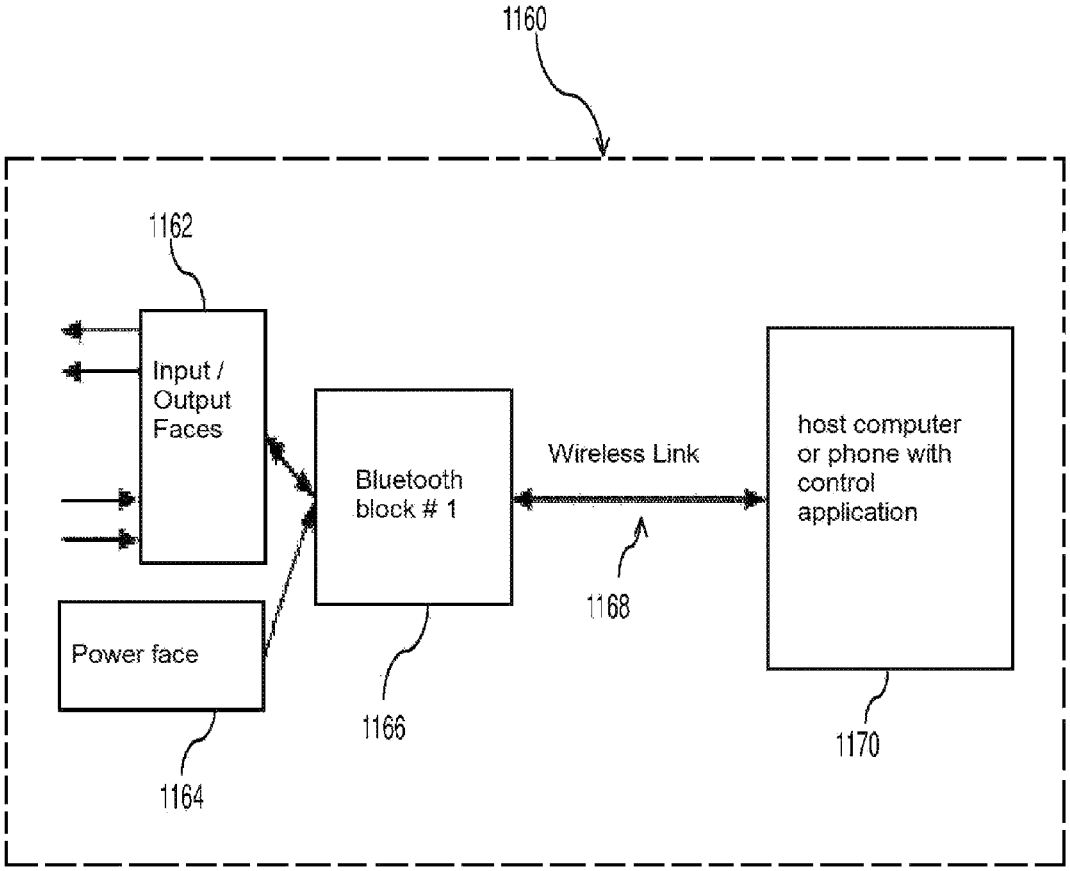

FIGS. 11A and 11B show details of what is referred to herein as a "think block" 1100 or generally a module that has the ability to receive, process and distribute instructions to one or more other modules. More specifically, FIG. 11A illustrates a schematic of a think block 1100 with input faces 1102, a power face 1104, an externally programmable microcontroller 1106, and output faces 1108. FIG. 11B illustrates a schematic of a Bluetooth think block 1130 with input/output faces 1132, a power face 1134, a first Bluetooth block 1136, a wireless link 1138, a second Bluetooth block 1140, another set of input/output faces 1142, and another power faces 1144. FIG. 11C illustrates another Bluetooth think block 1160 having input/output faces 1162, a power face 1164, a Bluetooth block 1166, and a wireless link 1168 to a host computer or phone 1170. The think block 1100, 1130, 1160 may be a powerful information processing bock. In addition to a power face 1104, 1134, 1164 to power the internal microcontroller, this block can be configured with each additional face as an output or input. The outputs can be programmed either in open loop, or as a function of the inputs. This enables robots with high level logic and control. FIGS. 11A-11C show an electrical schematic diagram of the think block 1100 with the associated functions that are attendant in the think block operation. For instance, an open-loop walking motion may be generated by a think block outputting two sinusoidal signals 90 degrees out of phase connected to two appropriately constructed legs. Incorporating an input connected to a knob block that adjusts the frequency of the sinusoidal signals will now adjust the speed of walking and embodies a higher level interactive control.

Figure 12:
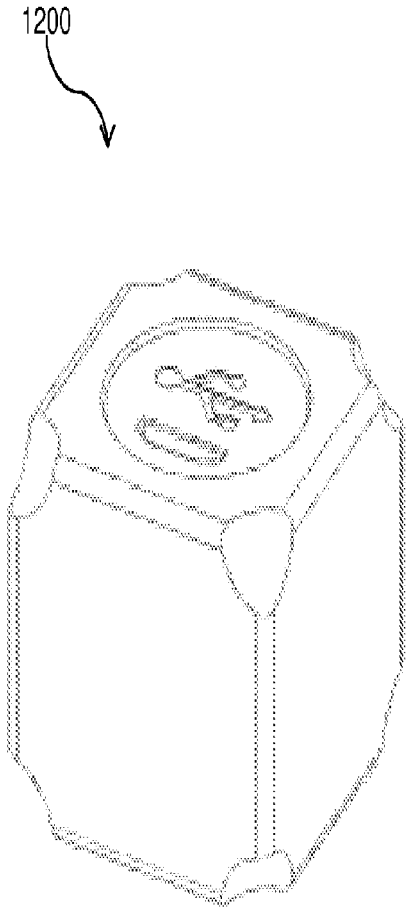
FIG. 12 shows a USB block in accordance with aspects of the present invention.

USB Block (FIG. 12)

FIG. 12 shows one example of a USB block 1200. The USB block provides a standard USB port that allows the block to be synced to a host computer to set up a master (computer)/slave (module) creation or vice versa. This enables creations to have virtually unlimited processing power when connected to a computer. Additionally, an internal microprocessor may be re-programmed via the USB connection to a host computer to change the behavior of the block after the USB cable has been removed. Other data and/or power communication systems may also be incorporated into this type of block including the use of FireWire and Lightning Bolt system standards.

Bluetooth Block

In another embodiment (not shown), a block may incorporate one or more types of communication protocols, such as Bluetooth, WiFi, near field communications (NFC), or any other communication protocol. The Bluetooth block serves two functions. First, the block can be synced to a host computer to set up a master (computer)/slave (module) creation or vice versa. Alternatively, two Bluetooth blocks can be synced together to provide a wireless link with 4 channels. In this mode, each face on a block corresponds to a single face on the other. The direction of information travel must be set, then the value on the output face will always mirror that of the input face. A block can have both inputs and outputs.

Signal Generator Block

In accordance with another embodiment, a signal generator block (not shown) embodies a simple case of a general think block where the output face(s) of the signal generator block are periodic functions such as a sine wave, triangle wave, square wave, etc. The frequency, amplitude, and phase of these signals can be set with a combination of the on-board knob and small switches and/or trimmer pots. This enables complex open loop behaviors to be specified in a construction without the need to connect to a computer and reprogram the block.

Figure 13A:
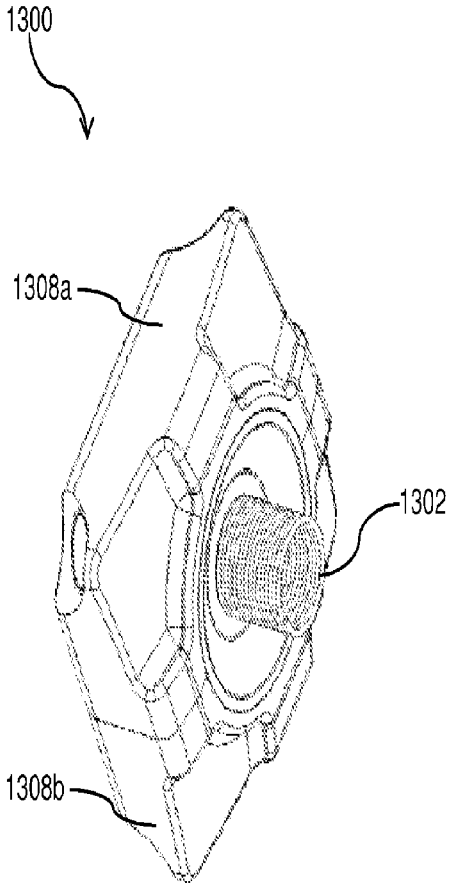
FIGS. 13A-13C show one symmetrical half of an embodiment of a flexible connection block in accordance with aspects of the present invention.
Figure 13B:
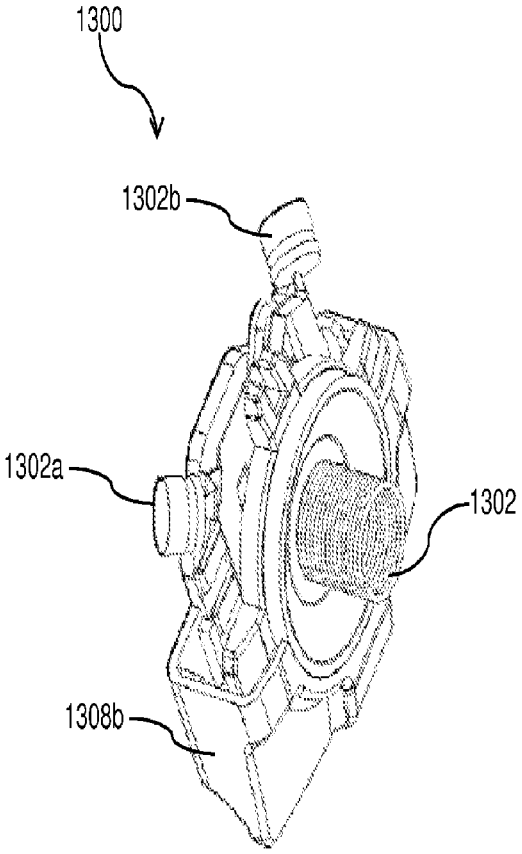
Figure 13C:
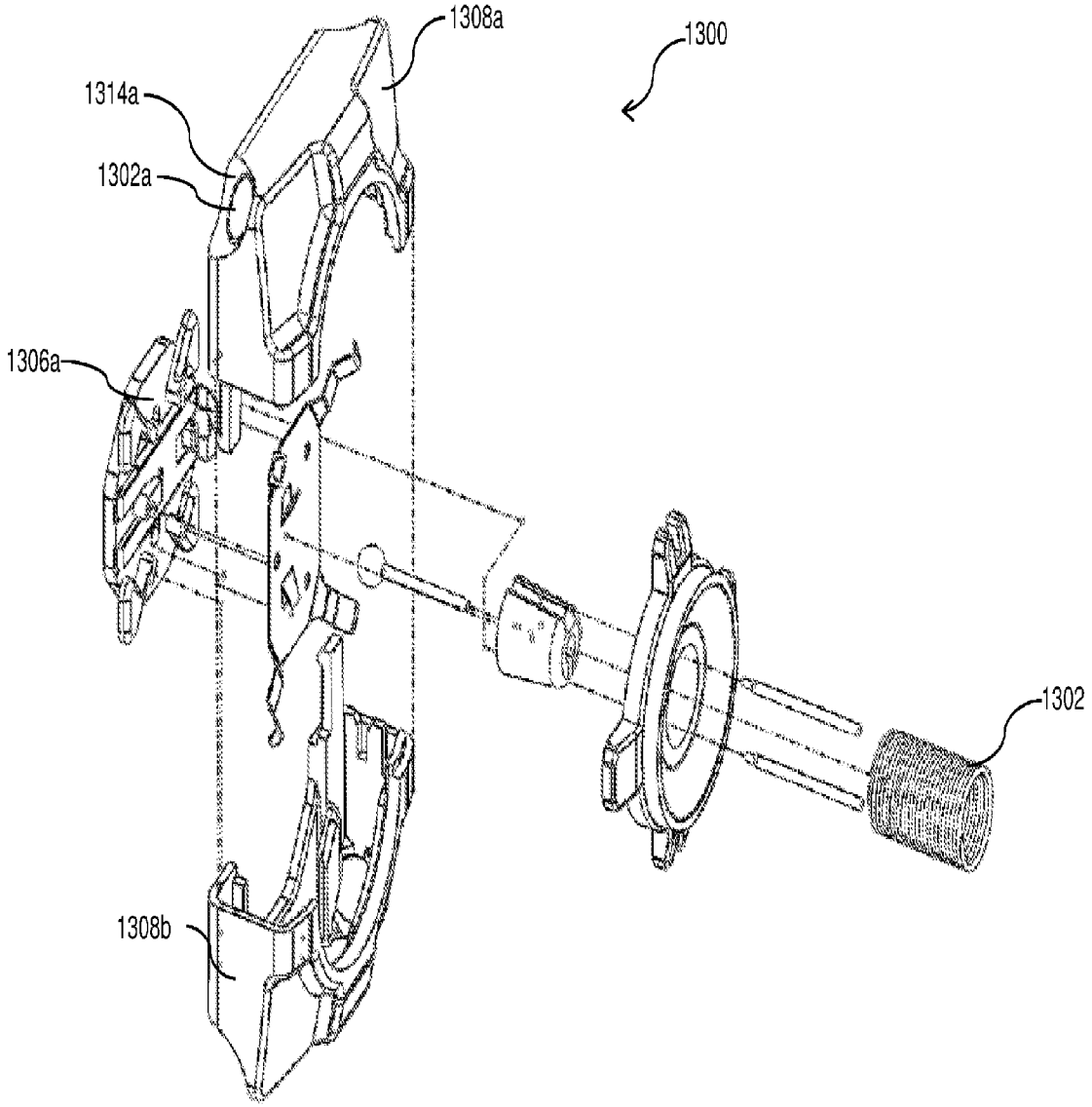

Flexible Connection Block (FIGS. 13A-13C)

Figure 13D:
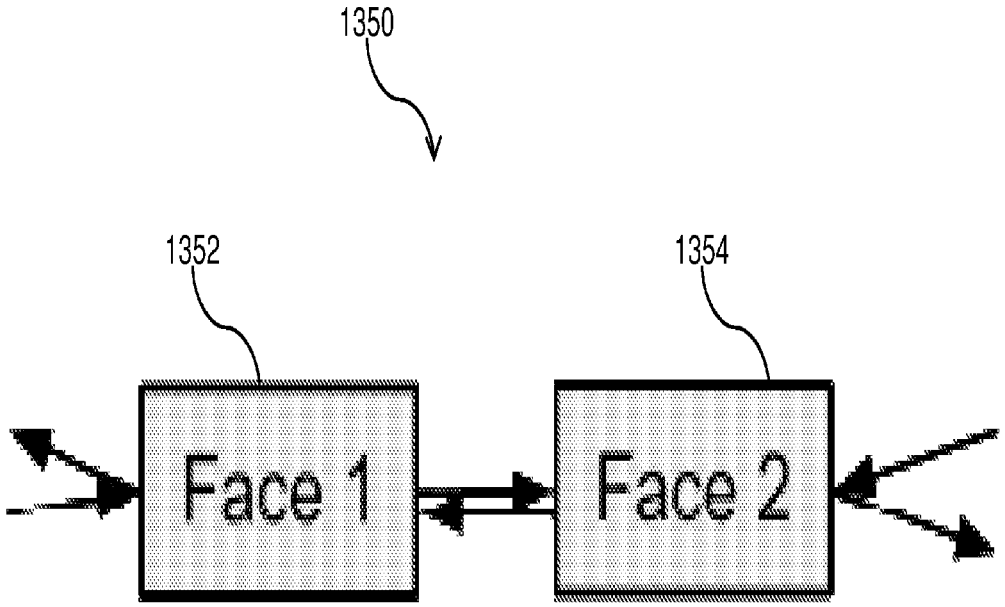
FIG. 13D shows an embodiment of a functional diagram for several of the blocks described herein, including the flexible connection block and unit block.

FIGS. 13A-13C show an embodiment of a flexible connection block 1300. Flexible connection block 1300 is a simple electrical pass-through block. The two faces are electrically connected. A flexible link 1302 allows it to be used in situations where motion of two modules would cause a static connection to break. FIG. 13D illustrates an electrical schematic 1350 of the face to face connection enabled by the flexible connection block 1300 showing the simple electrical pass through design. Aspects such as the shell halves, magnet recesses at each corner and corner magnets for each of the magnet recesses are similarly presented as they are for the other blocks described above.

Figure 14A:
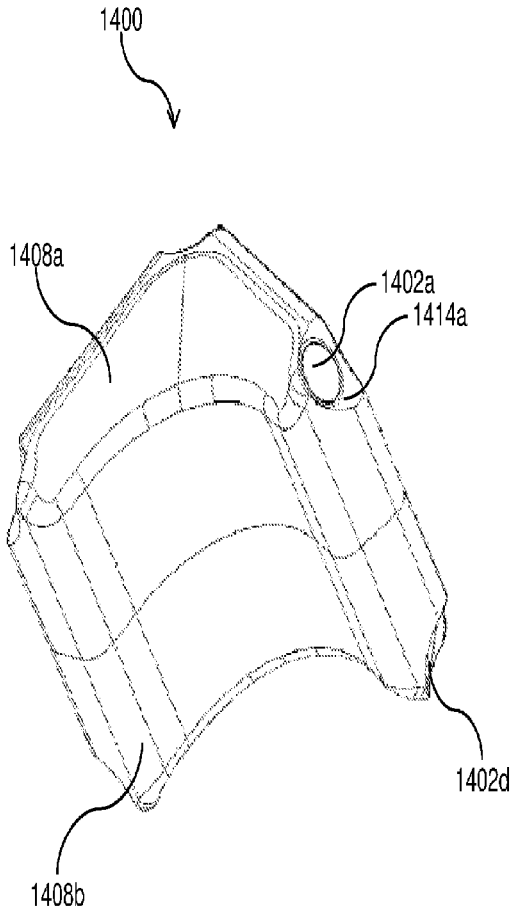
FIGS. 14A-14C show one embodiment of an L block in accordance with aspects of the present invention.
Figure 14B:
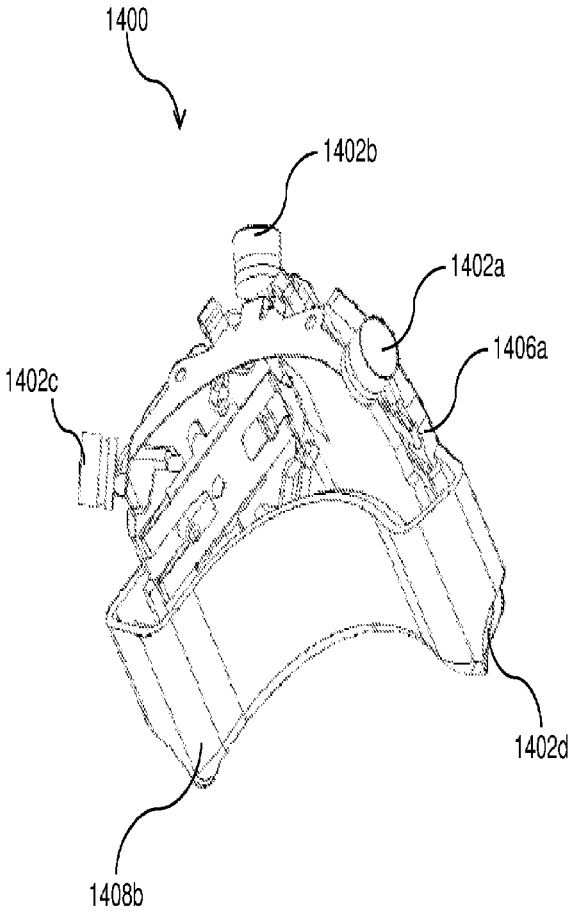
Figure 14C:
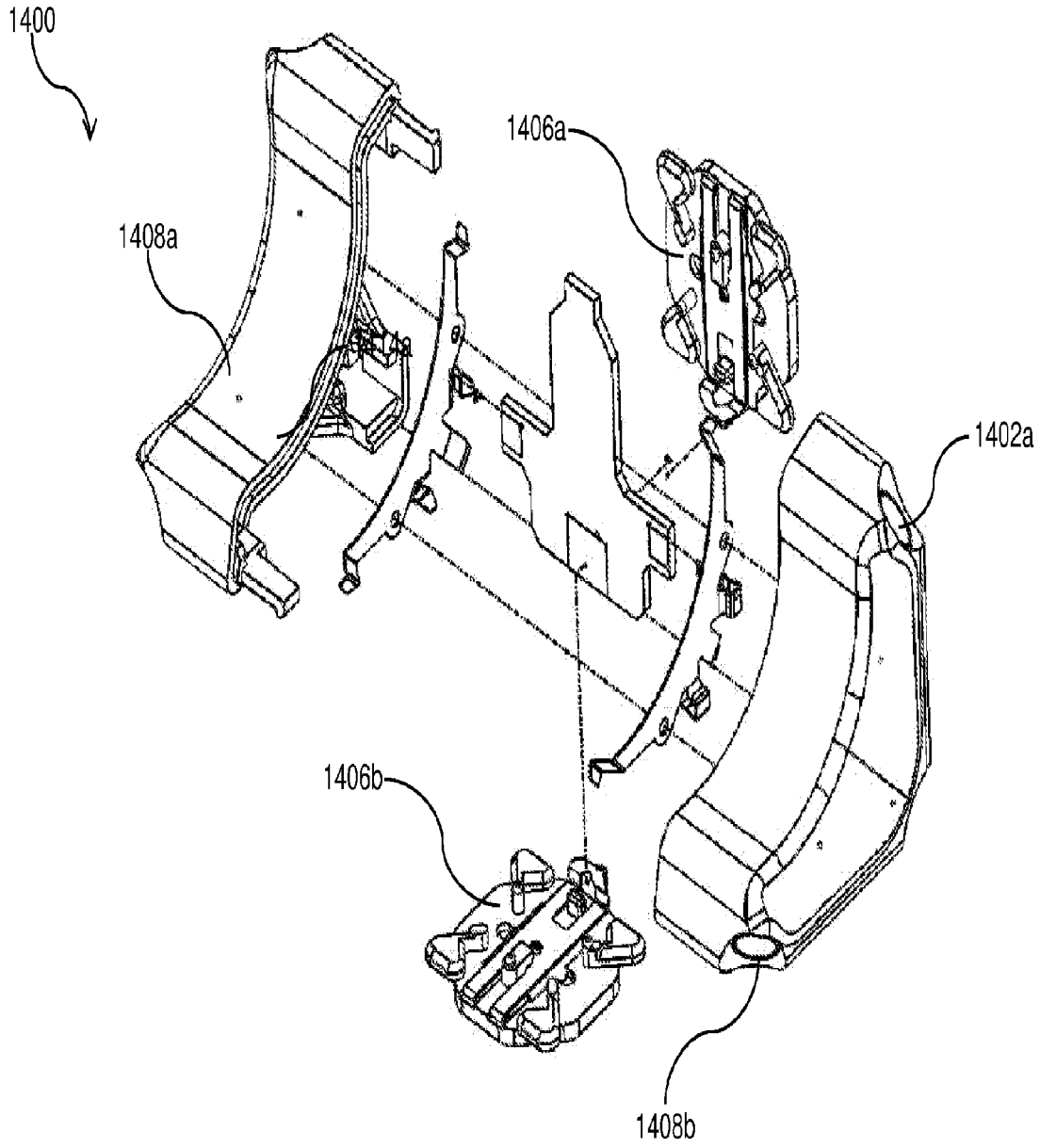

L-Block (FIGS. 14A-14C)

FIGS. 14A-14C show an embodiment of an L block 1400. The L block is another embodiment of a simple electrical pass-through block. While the two faces are electrically connected, the mechanical shape allows it to be used in situations where a full basic block would not be appropriate. Aspects such as the shell halves, magnet recesses at each corner and corner magnets for each of the magnet recesses are similarly presented as they are for the other blocks described above. The L block 1400 includes shell halves 1408*a* and 1408*b*, magnet recesses 1414*a*-1414*f* at each corner and a corner magnet 1402*a*-1402*f* for each of the magnet recesses 1414*a*-1414*f*. Face contacts 1404*a*-1404*b* are located on each of the faces 1406*a*-1406*b*.

Other Utility Blocks

Several other mechanical or utility blocks are included to extend the functionality of creations including wheels and structural elements. These include such aspects and design elements as a 2× unit block 1500 (FIG. 15A) or an Nx unit 1502 (spanning three or more units) block (FIG. 15B), which provide mechanical rigidity and many connection possibilities for a large or complex structure. A 1× cover 1504 (FIG. 15C), a 2× cover 1506 (FIG. 15D), an Nx cover 1508, covering three or more blocks (FIG. 15E-1), cap a series of faces providing a common electrical connection in a small space as well as mechanical rigidity. A 2× span 1510 (FIG. 15E-2) and an Nx span 1512, spanning three or more blocks (FIG. 15F), are useful for creating lightweight kinematic links as well as aesthetically pleasing structural reinforcement. A hubbed wheel block 1514 (FIG. 15G), a non-hubbed wheel block 1516 (FIG. 15H), a passive roller block 1518 (FIG. 15I), and a passive omni-directional roller block 1520 (FIG. 15J) each provide unique motion possibilities and an adapter 1522 (FIG. 15K) interfaces mechanically with other toy construction kits, such as LEGO™ brand construction kits.

Several other action blocks may be provided in one or more embodiments including a drive block 1600 (FIG. 16A) that rolls along the ground at a speed proportional to its input, and a light/speaker block 1602 (FIG. 16B) that outputs colored or white light according to its input or outputs sounds according to its input. Also a display block 1604 (FIG. 16C) shows pertinent information in graphical form, a fan block 1606 (FIG. 16D) that creates wind (or thrust) according to its input value, and a vibrating block 1608 (FIG. 16E) that vibrates stochastically according to its input.

Several other sensing blocks may be provided in one or more embodiments including a range sensor 1700, which uses infrared or ultrasonic sensing, for example, (FIG. 17A) that outputs a value corresponding to the distance at which an object is sensed in front of it. A light/temperature/motion/microphone/camera 1702 (FIG. 17B) block senses overall light or ambient temperature or motion within its field of view or sound or spatial light pattern and outputs a value accordingly based on its internal configuration of hardware. A block may have one or multiple of these functions. A whisker touch sensor 1704 (FIG. 17C) and a button block 1706 (FIG. 17D) detect a physical force applied to them and output a continuous or binary output accordingly.

A joystick block 1708 (FIG. 17E) has two or more outputs corresponding to multiple axes. An environmental sensor 1710, e.g. magnetic field, accelerometer, gyroscope barometer, humidity, C02, particulate (FIG. 17F), and a voltmeter/ammeter 1712 (FIG. 17G), outputs a value according to the quantity sensed. A touch sensor 1714 (FIG. 17H), a roller knob 1716 (FIG. 17I), and a switch block 1718 (FIG. 17J) all provide a tactile input to a construction according to the specific component used.

Alternative Actuation Blocks

Figure 18A:
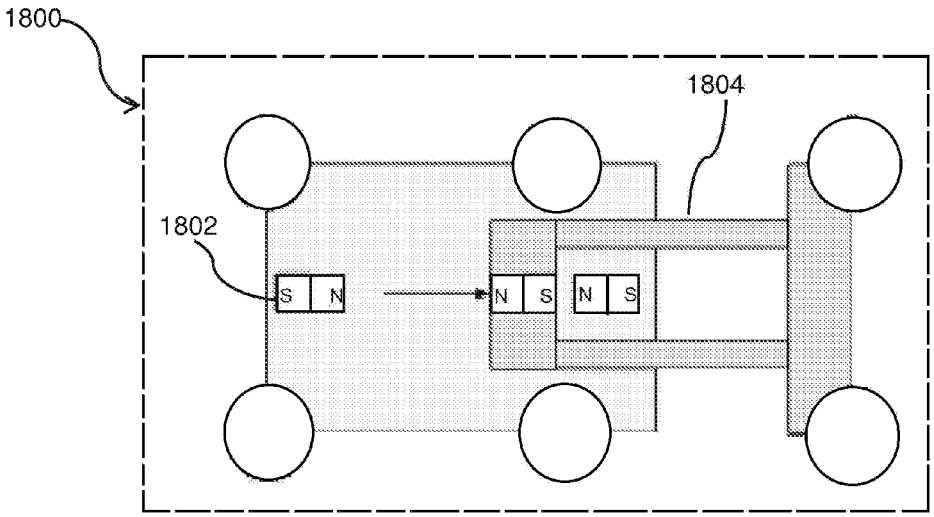
FIG. 18A-18B show additional embodiments of block elements constructed in accordance with additional aspects of the present invention.
Figure 18B:
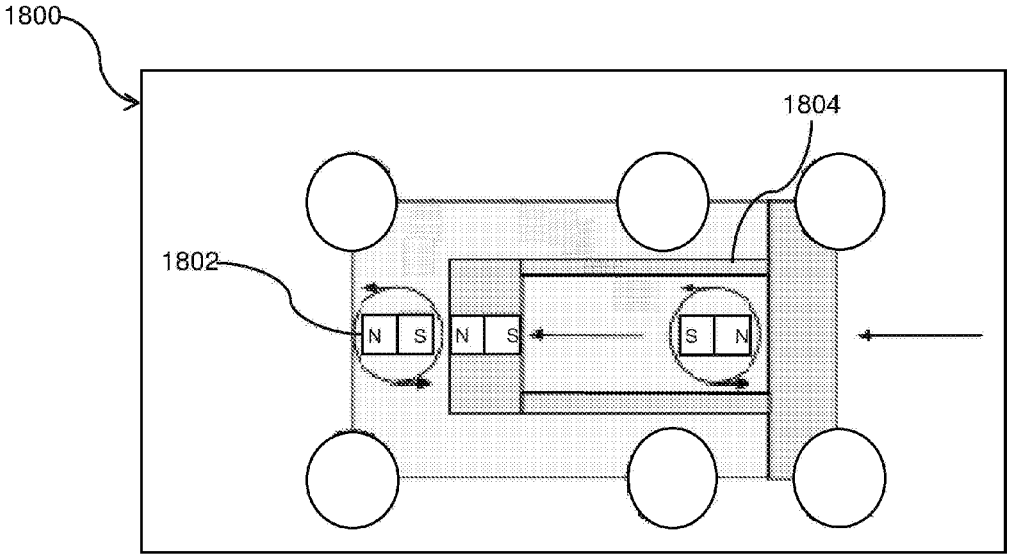

In addition to basic block functions and actuation techniques described above (servo, gear-motor, etc.), additional actuation modules are also described here. The first, shown in FIGS. 18A-18B, is a two state linear actuator 1800. By limiting the linear motion to two states (contracted and extended) a system can be designed that enables fast actuation but zero-energy holding power. The extended state is shown in FIG. 18A and the contracted state is shown in FIG. 18B. In this embodiment, energy is only needed to switch between the two states. This will be accomplished by reconfiguring the orientation of a magnet 1802 at each end of the range of travel that will alternately attract or repel a piston 1804, depending on the state.

FIG. 18B illustrates the polarity reversal of the magnet 1802 that will change the state of the piston 1804 and move the actuator from one position to another.

Figure 19A:
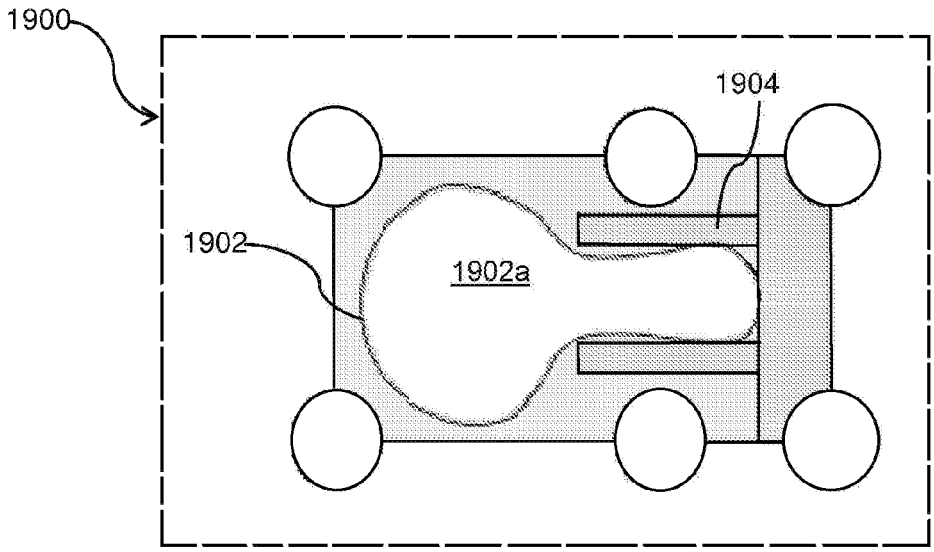
FIG. 19A-19B show additional embodiments of block elements constructed in accordance with further additional aspects of the present invention.
Figure 19B:
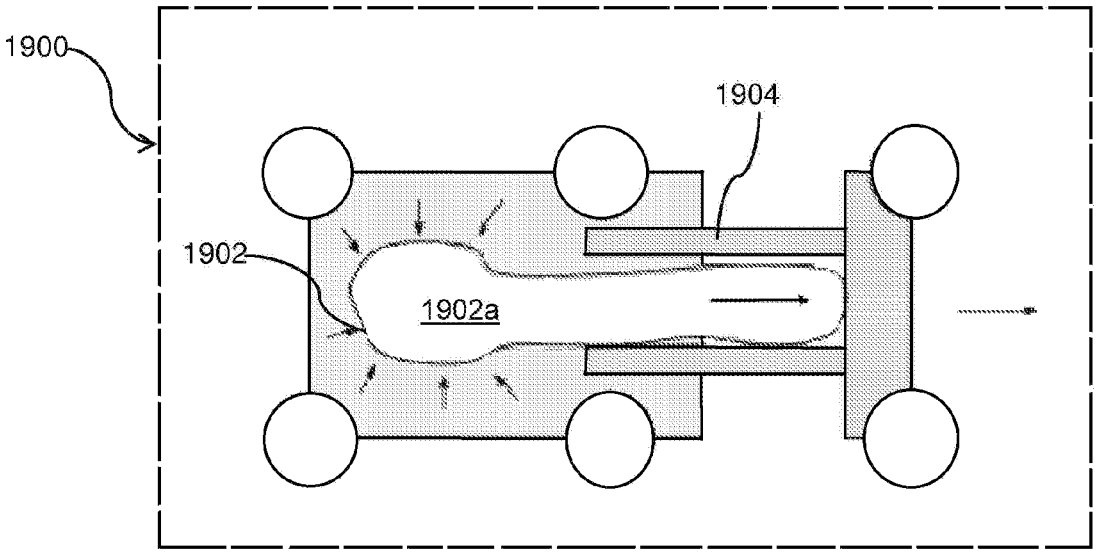

Another actuator block 1900, shown in FIGS. 19A-18B, that utilizes a flexible membrane 1902 filled with an incompressible fluid 1902*a*. The linear actuated motion of piston 1904 is thus kinematically constrained. By squeezing the fluid contained within the flexible membrane 1902 at one point, the remaining will expand and provide an actuation force for piston 1904. The squeezing action may be accomplished by wrapping shape memory alloy wire around one end of the membrane or otherwise. In a manner similar to hydraulics, these modules could be easily adapted from low force/high speed actuation to high force, low speed actuation.

Those skilled in the art can readily recognize that numerous variations and substitutions may be made in the invention, its use, and its configuration to achieve substantially the same results as achieved by the embodiments described herein. Accordingly, there is no intention to limit the invention to the disclosed exemplary forms. Many variations, modifications, and alternative constructions fall within the scope and spirit of the disclosed invention.

What is claimed is:

1. An educational or toy construction kit comprising:

a plurality of building modules, wherein at least one of the building modules is a functional module and adapted to perform a specific behavior, the at least one functional module comprising a plurality of corners, each of the plurality of corners having a corner electrical contact providing an electrical return path, and at least one functional face, the at least one functional face having an electrical contact providing an electrical source path, and the at least one functional module providing at least one of power output, power input, data output, data input, data pass-through, and power pass-through;

a plurality of spherical connectors, each of the plurality of spherical connectors adapted to couple one of the plurality of corners of the at least one functional module to a corner of at least one other module while providing up to three degrees of freedom between the at least one functional module and the at least one other module, each of the plurality of spherical connectors providing an electrical return path and not an electrical source path; wherein interconnection of the at least one functional module and the at least one other module forms a construction; and the at least one functional module comprises no corner electrical contacts that provide an electrical source path.

2. The construction kit of claim 1, wherein the at least one other module is a passive module adapted to engage with the at least one functional module.

3. The construction kit of claim 1, wherein the functional module includes an embedded device that processes instructions to instruct the functional module to perform the specific behavior.

4. The construction kit of claim 1, wherein each of the plurality of corners of the at least one of the plurality of building modules includes a recessed magnetic contact proximate to each of its corners.

5. The construction kit of claim 1, wherein the at least one other module is a second functional module adapted to engage with a face and any corner associated with the face of the at least one functional module.

6. The construction kit of claim 1, wherein the at least one functional building module further comprises reprogrammable software to enable end-users to reprogram the specific behavior of the functional building module.

7. A functional building module for use in a children's construction kit, the functional building module comprising:

an enclosure, the enclosure defining a plurality of corners and at least one functional face, the at least one functional face having an electrical contact providing an electrical source path, and the functional building module providing at least one of power output, power input, data output, data input, data pass-through, and power pass-through;

at least one electronic component mounted within the enclosure;

a plurality of recessed magnetic conductive contact surfaces located proximate to respective ones of the plurality of enclosure corners, each of the contact surfaces providing an electrical return path and not an electrical source path;

a plurality of spherical conductive connectors adapted to engage in respective ones of the plurality of recessed contact surfaces and adapted to provide up to three degrees of freedom between the functional building module and a second building component; and a grounding mesh coupled to each of the recessed contact surfaces and each of the plurality of spherical conductive connectors, whereby the functional building module is grounded to enable electrical coupling to the second building component such that the functional building module is agnostic as to orientation of the functional building module relative to the second building component.

8. The building module of claim 7, wherein the enclosure is substantially in the shape of a cube or a rectangular prism.

9. The functional building module of claim 8, wherein the functional building module is adapted to perform a specific function.

10. The functional building module of claim 9, wherein the function is selected from the group consisting of power, movement, and sensing.

11. The functional building module of claim 7, wherein the electrical component is a conductive wire.

12. The functional building module of claim 7, wherein the electrical component is a microprocessor.

13. The functional building module of claim 7, wherein the electrical component is a motor.

14. A toy construction kit comprising:

a plurality of building modules, wherein at least one of the building modules is functional and adapted to perform a specific behavior, each of the building modules including at least one connection face having an electrical contact providing an electrical source path and adapted to pass either data or power from a first face of a first building module to a first face of a second building module;

wherein each connection face of the building modules is electrically connected with each of the other faces;

a plurality of corner connectors, each of the plurality of corner connectors adapted to couple a respective corner of the at least one functional module to any one of a plurality of corners of at least one other module while providing up to three degrees of freedom between the functional module and the at least one other module, each of the plurality of corner connectors providing an electrical return path and not an electrical source path; wherein interconnection of the at least one functional module, the plurality of corner connectors, and the at least one other module forms the toy construction kit, wherein the construction kit has a ground mesh throughout regardless of which of the plurality of corners of the at least one other module are coupled to the at least one functional module.

15. The construction kit of claim 14, wherein the at least one building modules is a battery block.

16. The construction kit of claim 14, wherein the at least one building modules is a think block to receive, process, and distribute instructions to one or more other modules.

17. The construction kit of claim 14, wherein the at least one building modules is a rotational block.

18. The construction kit of claim 14, wherein the at least one building modules is a programmable block.

* * * * *